US005288393A

United States Patent [19]

Jessup et al.

[11] Patent Number: 5,288,393

[45] Date of Patent: Feb. 22, 1994

[54] GASOLINE FUEL

[75] Inventors: Peter J. Jessup; Michael C. Croudace, both of Santa Ana, Calif.

[73] Assignee: Union Oil Company of California, Los Angeles, Calif.

[21] Appl. No.: 628,488

[22] Filed: Dec. 13, 1990

[51] Int. Cl.[5] ..... C10L 1/04

[52] U.S. Cl. ..... 208/16; 208/14; 208/15; 208/18; 585/14

[58] Field of Search ..... 585/14; 208/15-17

[56] References Cited

U.S. PATENT DOCUMENTS

| | | | |
|---|---|---|---|
| 3,658,690 | 4/1972 | Graven | 208/92 |
| 3,753,670 | 8/1973 | Strang et al. | 44/432 |
| 3,886,759 | 6/1975 | McNamee | 62/54 |
| 3,903,194 | 9/1975 | Hutson, Jr. et al. | 260/683.48 |
| 3,955,938 | 5/1976 | Graham et al. | 44/305 |
| 3,957,901 | 5/1976 | Chapman | 260/683.43 |
| 3,988,122 | 10/1976 | Rosenthal et al. | 44/452 |
| 4,022,589 | 5/1977 | Alquist et al. | 44/58 |
| 4,118,425 | 10/1978 | Herbetman | 260/611 A |
| 4,214,876 | 7/1980 | Garth et al. | 44/404 |
| 4,215,997 | 8/1980 | Sandy | 44/367 |
| 4,220,120 | 9/1980 | Jackson, deceased et al. | 123/3 |
| 4,312,636 | 1/1982 | Singleman | 44/442 |
| 4,313,738 | 2/1982 | Parlman et al. | 44/63 |
| 4,319,981 | 3/1982 | Singerman | 44/447 |
| 4,322,304 | 3/1982 | Parlman et al. | 252/515 R |
| 4,324,569 | 4/1982 | Klimczak | 55/182 |
| 4,372,752 | 2/1983 | Lamy | 44/50 |
| 4,387,257 | 6/1983 | Burns | 585/14 |
| 4,388,081 | 6/1983 | Burns | 585/14 |
| 4,437,436 | 3/1984 | Graiff et al. | 44/56 |
| 4,468,233 | 8/1984 | Bruderreck et al. | 44/56 |
| 4,501,596 | 2/1985 | Burns | 44/341 |
| 4,508,617 | 4/1985 | Montgomery | 208/134 |
| 4,571,439 | 2/1986 | Keyworth | 568/697 |
| 4,579,990 | 4/1986 | Keyworth | 585/510 |
| 4,607,129 | 8/1986 | Lee | 585/415 |
| 4,647,368 | 3/1987 | McGuiness et al. | 208/60 |
| 4,699,629 | 10/1987 | Coudace et al. | 44/429 |
| 4,737,159 | 4/1988 | Phillips | 44/419 |
| 4,743,273 | 5/1988 | Croudace et al. | 44/418 |
| 4,773,916 | 9/1988 | Croudace et al. | 44/440 |
| 4,812,146 | 3/1989 | Jessup | 585/14 |
| 4,818,250 | 4/1989 | Whitworth | 44/62 |
| 4,824,552 | 4/1989 | Magusawa et al. | 208/17 |
| 4,844,717 | 7/1989 | Croudace et al. | 44/418 |
| 4,851,601 | 7/1989 | Fukuda et al. | 585/241 |
| 4,873,389 | 10/1989 | Avidan et al. | 585/533 |
| 4,884,531 | 12/1989 | Degnan, Jr. et al. | 123/3 |
| 4,899,014 | 2/1990 | Avidan et al. | 585/415 |
| 4,955,332 | 9/1990 | Talbert | 123/1 A |
| 5,015,356 | 5/1991 | Talbert | 208/16 |
| 5,041,208 | 8/1991 | Partridge et al. | 208/16 |

FOREIGN PATENT DOCUMENTS

| | | | |
|---|---|---|---|
| 213136 | 5/1957 | Australia | 208/17 |

OTHER PUBLICATIONS

"California Sets Tough Auto Standards" Jananne Sharpless in *Fuel Reformulation* published Nov./Dec. 1991, pp. 8-10.

"The Role of MTBE in Future Gasoline Production" by William J. Piel, *Energy Progress* (vol. 8, No. 4), Dec., 1988, pp. 201-204.

"Are the Reductions in Vehicle Carbon Monoxide Exhaust Emissions Proportional to the Fuel Oxygen Content?" by J. A. Gething, J. S. Weistand, and J. C. Horn, *SAE Techincal Paper Series*, 890216, SAE International Congress and Exposition, Detroit, Michigan, Feb. 27--Mar. 3, 1989.

"How Injector, Engine, and Fuel Variables Impact Smoke and Hydrocarbon Emissions with Port Fuel Injection" by Arthur A. Quader, *SAE Technical Paper*

(List continued on next page.)

*Primary Examiner*—Helane Myers

*Attorney, Agent, or Firm*—Gregory F. Wirzbicki

[57] ABSTRACT

By controlling one or more properties of a gasoline fuel suitable for combustion in automobiles, the emissions of NOx, CO and/or hydrocarbons can be reduced. The preferred fuel for reducing all three such emissions has a Reid Vapor Pressure no greater than 7.5 psi (0.51 atm), essentially zero olefins, and a 50% D-86 Distillation Point greater than about 180° F. (82° C.) but less than 205° F. (96.1° C.)

155 Claims, 9 Drawing Sheets

OTHER PUBLICATIONS

*Series,* 890623, SAE International Congress and Exposition, Detroit, Michigan, Feb. 27-Mar. 3, 1989.

"Engine Bench Evaluation of Gasoline Composition Effect on Pollutants Conversion Rate by a Three-Way Catalyst" by Michel F. Prigent, Brigitte C. Martin and Jean-Claude Guibet, *SAE Technical Paper Series,* 900153, SAE International Congress and Exposition, Detroit, Mich., Feb. 26-Mar. 2, 1990.

"Effect on Gasoline Quality on Throttle Response of Engines During Warm-up" by Minoru Tomita, Masanori Okada, Haruyuki Katayama and Masahiko Nakada, *SAE Techincal Paper Series,* 900163, SAE International Congress and Exposition, Detroit, Mich., Feb. 26-Mar. 2, 1990.

"The Effect of Gasoline Aromatics Content on Exhaust Emissions: A Cooperative Test Program" by Jeff A. Gething, S. Kent Hoekman, *SAE Technical Paper Series,* 902073, International Fuels and Lubricants Meeting and Exposition, Tulsa, Okla. Oct. 22-25, 1990.

*Octane Week,* Special NPRA Convention Edition, Week of Mar. 26, 1990, vol. IV, No. 44, pp. 1-14.

"Automotive Fuels for the 1990's-Challenges and Opportunities" by Joseph M. Colucci, Research Publication, General Motors Research Laboratories, GMR-6589, F&L-882, to be presented at DeWitt and Company-Petrochemical Review Seminar, Houston, Tex., Mar. 30, 1989.

"The Refiner's Key to Future Gasoline Production" by William J. Piel, National Petroleum Refiners Association, AM-88-66, 1988 Annual NPRA Meeting, San Antonio, Tex., Mar. 20-22, 1988.

"Vehicle Evaporative and Exhaust Emissions as Influenced by Benzene Content of Gasoline" by Donald E. Seizinger, William F. Marshall, Frank W. Cox, and Martin W. Boyd, National Institute for Petroleum and Energy Research, NIPER-151, DE86 010603, Apr. 16, 1986.

"The Effects of Aromatics Content on NOx Emissions" by Annette Reid Guerrero and James M Lyons, Toxics and Fuels Section, Mobile Source Division, California Air Resources Board, Mar., 1990.

"The Effect of Gasoline Aromatics on Emissions of Nitrogen Oxides in Vehicle Exhaust" by J. A. Gething, Chevron Research and Technology Company, Richmond, Calif., Apr. 19, 1990.

"Reformulated Gas No Help in Older Cars" by Matthew L. Wald, The New York Times, appearing in Orange County Register, Dec. 19,1990.

"Clean Gasoline" ARCO EC-1 Gasoline.

"Nationwide Gasoline Compositions" (MVMA and SwRI Surveys, 1988).

"Reformulated Gasoline" Industry Scoreboard.

"Regular Compositions" Average Results for 9 RVP Season.

"Premium Compositions" Average Results for 9 RVP Season.

"The Talbert Information Package" by Talbert Fuel Systems, Inc., date Dec. 3, 1990.

"A Study of Factors Influencing the Evaporative Emissions From In-Use Automobiles" API Publication No. 4406, Apr., 1985, American Petroleum Institute.

"The Effect of Fuel Volatility Variations on Evaporative and Exhaust Emissions," API Publication 4310, May, 1979, Prepared for the American Petroleum Insitute by Exxon Research and Engineering Company.

"Distillation Adjustment: An Innovative Step to Gasoline Reformulation" by Jeff A. Gething, SAE Technical Paper 910382, Feb. 25-Mar. 1, 1991.

"The Role of MTBE in Future Gasoline Production" by William J. Piel, *Energy Progress* (vol. 8, No. 4), Dec., 1988, pp. 201-204.

"Are the Reductions in Vehicle Carbon Monoxide Exhaust Emissions Proportional to the Fuel Oxygen Content?" by J. A. Gething, J. S. Weistand, and J. C. Horn, *SAE Technical Paper Series,* 890216, SAE Internaitonal Congress and Exposition, Detroit, Mich., Feb. 27-Mar. 3, 1989.

"How Injector, Engine, and Fuel Variables Impact Smoke and Hydrocarbon Emissions with Port Fuel Injection" by Ather A. Quader, *SAE Technical Paper Series,* 890623, SAE International Congress and Exposition, Detroit, Mich., Feb. 27-Mar. 3, 1989.

"Engine Bench Evaluation of Gasoline Composition Effect on Pollutants Conversion Rate by a Three-Way Catalyst" by Michel F. Prigent, Brigitte C. Martin and Jean-Claude Guibet, *SAE Technical Paper Series,* 900153, SAE International Congress and Exposition, Detroit, Mich., Feb. 26-Mar. 2, 1990.

"Effect on Gasoline Quality on Throttle Response of Engines During Warm-up" by Minoru Tomita, Masanori Okada, Haruyuki Katayama and Masahiko

OTHER PUBLICATIONS

Nakada, *SAE Technical Paper Series,* 900163, SAE International Congress and Exposition, Detroit, Mich., Feb. 26–Mar. 2, 1990.

"The Effect of Gasoline Aromatics Content on Exhaust Emissions: A Cooperative Test Program" by Jeff A. Gething, S. Kent Hoekman, *SAE Technical Paper Series,* 902073, International Fuels and Lubricants Meeting and Expoxition, Tulsa, Okla. Oct. 22–25, 1990.

*Octane Week,* Special NPRA Convention Edition, Week of Mar. 26, 1990, vol. IV, No. 44, pp. 1–14.

"Automotive Fuels for the 1990's–Challenges and Opportunities" by Joseph M. Colucci, Research Publication, General Motors Research Laboratories, GMR-6589, F&L-882, to be presented at DeWitt and Company-Petrochemical Review Seminar, Houston, Tex., Mar. 30, 1989.

"The Refiner's Key to Future Gasoline Production" by William J. Piel, National Petroleum Refiners Association, AMj-88-66, 1988 Annual NPRA Meeting San Antonio, Tex., Mar. 20–22, 1988.

"Vehicle Evaporative and Exhaust Emissions as Influenced by Benzene Content of Gasoline" by Donald E. Seizinger, William F. Marshall, Frank W. Cox, and Martin W. Boyd, National Institute for Petroleum and Energy Research, NIPER-151, DE86010603, Apr. 16, 1986.

"The Effects of Aromatics Content on NOx Emissions" by Annette Reid Guerrero and James M. Lyons, Toxics and Fuels Section, Mobile Source Division, California Air Resources Board, Mar. 1990.

"The Effect of Gasoline Aromatics on Emissions of Nitrogen Oxides in Vehicle Exhaust" by J. A. Gething, Chevron Research and Technology Company, Richmond, Calif. Apr. 19, 1990.

"Reformulated Gas No Help in Older Cars" by Matthew L. Wald, The New York Times, appearing in Orange County Register, Dec. 19, 1990.

"A Study of Factors Influencing the Evaporative Emissions From In-Use Automobiles" API Publication No. 4406, Apr., 1985, American Petroleum Institute.

"The Effect of Fuel Volatility Variations on Evaporative and Exhaust Emissions," API Publication 4310, May, 1979, Prepared for the American Petroleum Institute by Exxon Research and Engineering Company.

"Distillation Adjustment: An Innovative Step to Gasoline Reformulation" by Jeff. A. Gething, SAE Technical Paper 910382, Feb. 25–Mar. 1, 1991.

Information in Disclosure Statement No. 5 discussion only.

"The Talbert Information Package" by Talbert Fuel Systems, Inc., dated Dec. 3, 1990.

"Clean Gasoline" ARCO EC-1 Gasoline.

"Nationwide Gasoline Compositions" (MVMA and SwRI Surveys, 1988).

"Reformulated Gasoline" Industry Scoreboard.

"Regular Compositions" Average Results for 9 RVP Season.

"Premium Compositions" Average Results for 9 RVP Season.

+ + + 1989 Calais □ □ □ 1988 Olds 98
• • • 1990 Lincoln • • • 1989 Taurus
● ● ● 1990 Shadow ◇ ◇ ◇ 1990 Camry

*Figure 7*

| Car | Fuel Variable | | | | | | | | | | $R^2$ |
|---|---|---|---|---|---|---|---|---|---|---|---|
| | Arom | Olef | Para | MTBE | RON | MON | T10 | T50 | T90 | RVP | |
| 1989 Calais | | | - | | | | | + + + | | | 0.974 |
| 198 Oldsmobile 98 | | | - | | | | | + | | | 0.974 |
| 1985 Tempo | | | - | | | | | + + | | | 0.972 |
| 1990 Lincoln | | | | | | | | + | | | 0.971 |
| 1984 Caprice | - | | | | | | | + | | | 0.926 |
| 1988 Accord | | | | | | | | + | | | 0.944 |
| 1989 Taurus | | | | | | | | + | | | 0.980 |
| 1990 Shadow | | | – | | | | | + | + | | 0.966 |
| 1985 Suburban | | | + | | | | | + + | (-) | | 0.962 |
| 1990 Camry | | | - | | | | | + + | | | 0.968 |

Note: () indicates minor effects

*Figure 8*

| Car | Fuel Variable | | | | | | | | | | $R^2$ |
|---|---|---|---|---|---|---|---|---|---|---|---|
| | Arom | Olef | Para | MTBE | RON | MON | T10 | T50 | T90 | RVP | |
| 1989 Calais | | + | (-) | | | | (+) | | | + + + | 0.973 |
| 1988 Oldsmobile 98 | | + | | | | | (+) | | | + + + | 0.965 |
| 1985 Tempo | | + | | | | | (+) | | | + + + + | 0.992 |
| 1990 Lincoln | | + | | | | | + | | | + + + + + + + + + + | 0.995 |
| 1984 Caprice | | + | | | | | + | | | + + + + | 0.994 |
| 1988 Accord | | + | (-) | | | | (+) | | | + + + + + + + + + + | 0.978 |
| 1989 Taurus | | + | | | | | (+) | | | + + + + + | 0.991 |
| 1990 Shadow | | + | | | | | (+) | | | + + + + + + + + | 0.995 |
| 1985 Suburban | | + | | | | | + | | | + + + + + | 0.990 |
| 1990 Camry | | + | | | | | (+) | | | | 0.894 |

Note: () indicates minor effects

*Figure 9*

| Car | Fuel Variable | | | | | | | | | | $R^2$ |
|---|---|---|---|---|---|---|---|---|---|---|---|
| | Arom | Olef | Para | MTBE | RON | MON | T10 | T50 | T90 | RVP | |
| 1989 Calais | | + + | | | – | | | + | | | 0.967 |
| 1988 Oldsmobile 98 | | | | | - | | | + | | | 0.948 |
| 1985 Tempo | – | | | | | | | + | | | 0.993 |
| 1990 Lincoln | - | | | | | | | + | | | 0.961 |
| 1984 Caprice | – | | | | | | | + | | | 0.952 |
| 1988 Accord | – | | | | | | | + | | | 0.951 |
| 1989 Taurus | | + | | | - | | | + | | | 0.973 |
| 1990 Shadow | - | | | | | | | + | | | 0.965 |
| 1985 Suburban | - | | | | | | | + | | | 0.988 |
| 1990 Camry | | + + | | | - | | | + | | | 0.977 |

GASOLINE FUEL

The present invention relates to fuels, particularly gasoline fuels, and combustion methods therefor, and methods for preparing gasoline fuels which, upon combustion, minimize the release of CO, NOx, and/or hydrocarbon emissions to the atmosphere.

One of the major environmental problems confronting the United States and other countries is atmospheric pollution (i.e., "smog") caused by the emission of gaseous pollutants in the exhaust gases from automobiles. This problem is especially acute in major metropolitan areas, such as Los Angeles, Calif., where the atmospheric conditions and the great number of automobiles account for aggravated air pollution.

It is well known that the three primary gaseous constituents, or pollutants, which contribute to air pollution due to auto exhaust are nitrogen oxides (NOx), carbon monoxide (CO), and unburned or incompletely burned hydrocarbons (i.e., hydrocarbon components originally present in the gasoline fuel which are not fully converted to carbon monoxide or dioxide and water during combustion in the automobile engine).

SUMMARY OF THE INVENTION

The present invention provides gasoline fuels from which a relatively low amount of gaseous pollutants, and in particular one or more of NOx, CO, and hydrocarbons, is produced during combustion in an automotive engine. The invention provides methods for producing gasoline fuels having such desirable properties. The invention also provides methods of combusting such fuels in automotive engines while minimizing emission of pollutants released to the atmosphere, which in turn provides a method for reducing air pollution, particularly in congested cities and the like, when large volumes of automotive fuel of the invention are combusted in a great number of automobiles in a relatively small geographical area.

The present invention also provides a petroleum refiner with knowledge of which properties of a gasoline fuel to alter, and in which direction (i.e., increased or decreased), so as to produce a gasoline fuel which will reduce or minimize NOx, CO, and hydrocarbon emissions upon combustion in an automotive engine.

The present invention, in its broadest aspect, is founded on the discovery that, when gasoline fuels are produced, for example, by blending a plurality of hydrocarbon-containing streams together so as to produce a gasoline product suitable for combustion in an automotive spark-induced internal combustion engine, improvements in emissions of one or more pollutants selected from the group consisting of CO, NOx, and hydrocarbons upon combustion of the gasoline product in such an engine system can be attained by controlling certain chemical and/or physical properties of said gasoline product. For example, a first hydrocarbon-containing stream boiling in the gasoline range can be blended with a different hydrocarbon stream at rates adjusted so as to effect at least one of the properties of the first gasoline stream as follows:

(1) decrease the 50% D-86 Distillation Point;
(2) decrease the olefin content;
(3) increase the paraffin content;
(4) decrease the Reid Vapor pressure;
(5) increase the Research Octane Number;
(6) decrease the 10% D-86 Distillation Point;

(7) decrease the 90% D-86 Distillation Point; and
(8) increase the aromatic content The greater the increase or decrease of the eight properties as set forth above, the greater the resulting benefit in reducing emissions of one or more of CO, NOx, and hydrocarbons.

For gasoline fuels in which one desires that hydrocarbon emissions and/or CO emissions be minimized or reduced, the principal factor influencing such emissions is the 50% D-86 distillation point, with decreases therein causing decreases in the hydrocarbon emissions. Fuels generally prepared in accordance with this embodiment of the invention have a 50% D-86 distillation point no greater than 215° F. (101.6° C.), with the hydrocarbon and CO emissions progressively decreasing as the 50% D-86 distillation point is reduced below 215° F. (101.6° C.). Preferred fuels have a 50% D-86 Distillation Point of 205° F. (96.1° C.) or less. Best results are attained with fuels having a 50% D-86 distillation point below 195° F. (90.6° C.).

For gasoline fuels in which one desires that emissions of NOx be minimized or reduced, the principal factor influencing such emissions is Reid Vapor pressure. NOx emissions decrease as the Reid Vapor Pressure is decreased (e.g., to 8.0 psi (0.54 atm) or less, preferably to 7.5 psi (0.51 atm) or less, and even more preferably below 7.0 psi (0.48 atm)). Of secondary importance with respect to NOx emissions are the 10% D-86 Distillation Point and the olefin content. In general, decreasing olefin content (e.g., below 15 volume percent, preferably to essentially zero volume percent) and/or decreasing the 10% D-86 Distillation Point (e.g., to values below 140° F. (60° C.)) will provide some reduction in NOx emissions. However, because it is contemplated that decreases in olefin content will be more acceptable to an oil refiner than decreasing the 10% D-86 Distillation Point sufficiently to significantly affect the NOx emissions, it is believed that, as a practical matter, it will be olefin content which will be the secondary variable providing the most flexibility to an oil refiner in altering the gasoline properties to reduce NOx emissions. (This is all the more the case inasmuch as, in general, if one wishes to decrease the Reid Vapor Pressure, it is usually necessary to increase the 10% Distillation Point.) Accordingly, best results are attained when both the olefin content is below 15 volume percent (preferably to zero) and the Reid vapor pressure is no greater than 7.5 psi—with it being highly desirable, if possible, to also maintain the 10% D-86 Distillation Point below 140° F. (60° C.).

In view of the foregoing, it can be seen that many modifications of the invention are possible, depending upon which of the three pollutants one desires to reduce and the degree of reduction desired. For example, one can attain significant reductions in all three pollutants—hydrocarbons, CO, and NOx--by maintaining the 50% D-86 distillation point at or below about 215° F. (101.6° C.) and maintaining the Reid Vapor Pressure no greater than 8.0 psi (0.54 atm). Still better reductions can be obtained by maintaining the olefin content below 10 volume percent, or maintaining the 10% D-86 distillation point below 140° F. (60° C.), with still further reductions being possible when both the olefin content and 10% D-86 Distillation Point are so maintained. Yet further reductions are possible by maintaining the 50% D-86 distillation point below 195° F. (90.6° C.), by reducing the olefin content to below 5.0 vol.% (preferably to essentially zero), by decreasing the 10% D-86

Distillation Point to below 120° F. (49° C.), and/or by maintaining the Reid Vapor pressure below 7.0 psi (0.48 atm).

The presently preferred specifications proposed for commercial use for a gasoline produced in accordance with the invention are (1) Olefin Content of 0%; (2) Reid Vapor Pressure of 7.5 psi (0.51 atm) maximum; and (3) 50% D-86 distillation point greater than 180° F. (82° C.) but no greater than 205° F. (96° C.). However, other fuels falling within the scope of the invention are also possible, for example, fuels meeting the following criteria:

(1) a 50% D-86 distillation point no greater than 215° F. (101.7° C.) and a Reid Vapor Pressure no greater than 8.0 psi (0.54 atm).
(2) a 50% D-86 distillation point no greater than 205° F. (96° C.) and an olefin content less than 3 percent by volume;
(3) a Reid Vapor Pressure no greater than 8.0 psi (0.54 atm) and containing at least 40 volume percent paraffins;
(4) a Reid Vapor Pressure no greater than 7.5 psi (0.51 atm) and containing essentially no methyl tertiary butyl ether but less than 15 volume percent olefins.

One of the main advantages of the invention is that a less polluting gasoline fuel is provided that can be easily prepared in a petroleum refinery or the like. That is, in a typical refinery in which gasoline is produced, it is necessary or at least desirable in most instances to blend the hydrocarbon stocks so as to produce gasolines of specified Reid Vapor Pressure, olefins content, etc. Thus, the only difference is that now the refinery will blend the stocks in light of the information provided herein such that the NOx, CO, and hydrocarbon emissions are reduced as much as possible or practicable, given the individual situation (the blend stocks available, refining capacity, etc.) facing the particular refinery.

It will be understood in this disclosure and the claims to follow that the words "reduce" and "reducing" in the context of lowering NOx, CO, or hydrocarbon emissions are relative terms. Obviously, the simplest way to produce no emissions is to combust no fuel; and equally obviously, almost any combustion of a gasoline fuel will produce some emissions and thus produce greater emissions than if no fuel were combusted. However, on the assumption that the motoring public would find the consequences of combusting no fuel rather unattractive, logic dictates in the context of this invention that "reducing" is in comparison to the results achievable with other fuels. For example, for those embodiments of the invention in which the 50% D-86 Distillation Point is controlled to no more than 200° F. (93° C.), the emissions will be reduced in comparison to the otherwise identical fuel but having a higher 50% D-86 Distillation Point when combusted in the same automotive engine (or in an equivalent number of automotive engines) operating for the same time period in the same way.

BRIEF DESCRIPTION OF THE DRAWING

The invention can be best understood with reference to the drawing, the figures of which provide graphical or tabular data derived from the experiments described hereinafter with respect to Examples 2 and 3.

More particularly.

FIG. 7 is a table, based on data derived from the experiments in Examples 2 and 3, which identifies the most significant variables which increase emissions of CO when the variable is increased (as identified by one or more + signs) or which decrease emissions of CO when the variable is decreased (as identified by one or more − signs).

FIG. 8 is a table, based on data derived from the experiments in Examples 2 and 3, which identifies the most significant variables which increase emissions of NOx when the variable is increased (as identified by one or more + signs) or which decrease emissions of NOx when the variable is decreased (as identified by one or more − signs).

FIG. 9 is a table, based on data derived from the experiments in Examples 2 and 3, which identifies the most significant variables which increase emissions of hydrocarbons when the variable is increased (as identified by one or more + signs) or which decrease emissions of hydrocarbons when the variable is decreased (as identified by one or more − signs).

DETAILED DESCRIPTION OF THE INVENTION

Figure 1:
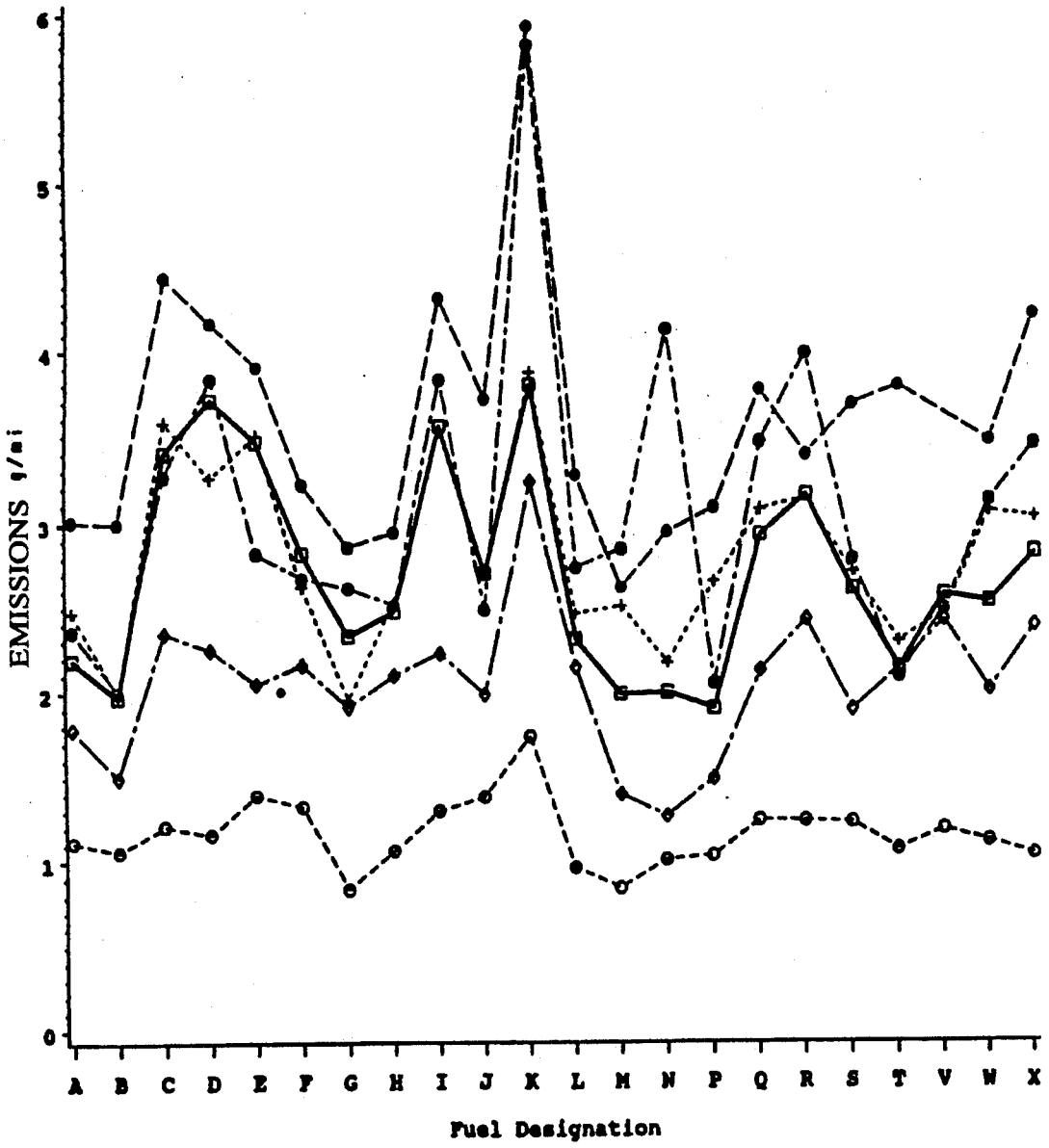
FIG. 1 is a graph of CO emission values for 22 different fuels tested in six different automobiles. Each data point on the graph is an average of a plurality of runs for each fuel-automobile combination.

The present invention is directed to gasoline compositions having chemical and physical properties which reduce and/or minimize the amount of gaseous pollutants emitted during combustion. In particular, the invention aims to reduce and/or minimize the emissions of hydrocarbons, NOx and/or CO during combustion in an automotive engine.

Gasolines are well known fuels, generally composed of a mixture of hydrocarbons boiling at atmospheric pressure in a very narrow temperature range, e.g., 77° F. (25° C.) to 437° F. (225° C.). Gasolines are typically composed of mixtures of aromatics, olefins, and paraffins, although some gasolines may also contain such added nonhydrocarbons as alcohol (e.g., ethanol) or oxygenates (e.g., methyl tertiary butyl ether). Gasolines may also contain various additives, such as detergents, anti-icing agents, demulsifiers, corrosion inhibitors, dyes, deposit modifiers, as well as octane enhancers such as tetraethyl lead. However, the preferred fuels contemplated in the invention are unleaded gasolines (herein defined as containing a concentration of lead no greater than 0.05 gram of lead per gallon (0.013 gram of lead per liter)). The preferred fuels will also have a Research Octane Number (RON) of at least 90. Octane value (R/2+M/2) for regular gasoline is generally at least 87 and for premium at least 92.

At present, most gasolines suitable for combustion in automotive spark-ignition engines conform to the requirements of ASTM D4814-89 specifications, which specifications are herein incorporated by reference in their entirety. Such gasolines fall into five different volatility classes, with some of the specifications therefor set forth in the following Table 1:

TABLE 1

| Properties | Class A | Class B | Class C | Class D | Class E |
|---|---|---|---|---|---|
| RVP (psi) max | 9.0 | 10.0 | 11.5 | 13.5 | 15.0 |
| (atm) max | 0.6 | 0.7 | 0.8 | 0.9 | 1.0 |
| Dist. 10% (°F.) max | 158 | 149 | 140 | 131 | 122 |
| (°C.) max | 70 | 65 | 60 | 55 | 50 |
| Dist. 50% (°F.) min-max | 170-250 | 170-245 | 170-240 | 170-235 | 170-230 |
| (°C.) min-max | 77-121 | 77-118 | 77-116 | 77-113 | 77-110 |
| Dist. 90% (°F.) min | 374 | 374 | 365 | 365 | 365 |
| (°C.) max | 190 | 190 | 185 | 185 | 185 |
| End Point (°F.) max | 437 | 437 | 437 | 437 | 437 |
| (°C.) max | 225 | 225 | 225 | 225 | 225 |

The most preferred gasolines produced in accordance with the invention are those which meet the requirements of one or more of the five classes specified in Table 1.

In the present invention, the gasoline is formulated, usually by appropriately blending various hydrocarbon streams in a refinery, to reduce or minimize emissions of CO, NOx, and/or hydrocarbons upon combustion in a spark-induced automotive internal combustion engine. It has been discovered in the present invention, for many automotive engines, that the amount of pollutants emitted upon combustion is closely in accord with the following equations:

Equation 1

$$CO(\text{gm per mile}) = K_1 \times (D\text{-86 Dist. 50\% Point in °F.}) + K_2 \times (D\text{-86 Dist. 90\% Point °F.}) - K_3 \times (\text{Vol. \% Paraffins})$$

Equation 2

$$NOx(\text{gm per mile}) = K_4 \times (\text{Vol. \% Olefins}) - K_5 \times (\text{Vol. \% Paraffins}) + K_6 \times (D\text{-86 Dist. 10\% Point in °F.}) + K_7 \times (RVP \text{ in psi})$$

Equation 3

$$HC(\text{gm per mile}) = K_8 \times (\text{Vol. \% Olefins}) - K_9 \times (\text{Research Octane Number}) + K_{10} \times (D\text{-86 Dist. 50\% Point in °F.})$$

where each K value in the foregoing equations is a positive number. The K values will be fixed for a particular engine in a particular car but can be readily determined. For example, for a 1988 Oldsmobile Regency 98 equipped with a 3.8 liter V-6 Engine, the K values are such that the equations are as follows:

Equation 4

$$CO(\text{gm per mile}) = 0.00937 \times (D\text{-86 Dist. 50\% Point in °F.}) + 0.00133 \times (D\text{-86 Dist. 90\% Point in °F.}) - 0.00828 \times (\text{Vol. \% Paraffins})$$

Equation 5

$$NOx(\text{gm per mile}) = 0.00503 \times (\text{Vol. \% Olefins}) - 0.00060 \times (\text{Vol. \% Paraffins}) + 0.00087 \times (D\text{-86 Dist. 10\% Point in °F.}) + 0.0159 \times (RVP \text{ in psi})$$

Equation 6

$$HC(\text{gm per mile}) = 0.00245 \times (\text{Vol. \% Olefins}) - 0.00104 \times (\text{Research Octane Number}) + 0.00109 \times (D\text{-86 Dist. 50\% Point in °F.})$$

From the foregoing equations, and from the relative sizes of the various K values and the typical values which would pertain for the properties by which the K values are multiplied (e.g., Vol. % Olefins, Research Octane Number, etc.), the following conclusions are obtained for the 1988 Oldsmobile Regency 98 and similar automobiles: For CO emissions, although decreasing the 90% D-86 distillation point has some impact on lowering CO emissions, the paraffin content and the 50% D-86 Distillation point influence such emissions much more substantially. All other things being equal, increasing the paraffin content or reducing the 50% D-86 distillation point will provide the most dramatic effects in reducing CO emissions, with best results being attained when both the paraffin content is substantially increased and the 50% D-86 distillation point is substantially reduced. In like manner, it can be seen that by decreasing the 10% D-86 Distillation Point and/or by increasing the paraffin content, some decrease in the NOx emissions will be produced. However, far more influential on the NOx emissions are the olefin content and the Reid Vapor Pressure, both of which cause substantial reductions in NOx emissions as they are substantially decreased. For hydrocarbon emissions, inspection of the equations indicates, since one is usually constrained to no more than a 5 unit change in Research Octane Number in the range of about 90 to 95, that it will not normally be practicable to alter the Research Octane Number sufficiently to have a significant impact on the hydrocarbon emissions. Accordingly, although some reduction in hydrocarbon emissions can be attained by increasing the Research Octane Number, the most practical way to significantly lower the hydrocarbon emissions while retaining other beneficial properties of the fuel is by lowering the olefin content and/or by lowering the 50% D-86 Distillation Point.

The foregoing equations also provide those skilled in the art, again as to a 1988 Oldsmobile Regency 98 and similar automobiles, with information as to how to lower the reductions of not just CO, NOx, or hydrocarbons, but also any combination thereof. For example, if one is interested in reducing the emission levels of all three, the equations show, if all other properties are held essentially constant, that reducing the Reid Vapor Pressure and the 50% D-86 distillation point will decrease the emissions of CO, NOx, and hydrocarbons. Likewise, decreases in these three pollutants can be attained by decreasing the 50% D-86 Distillation Point and decreasing the olefin content.

The above equations also lead to the following conclusions (again as to the 1988 Oldsmobile Regency and similar automobiles):

All other properties of a gasoline fuel being substantially the same,

1. As the 50% D-86 Distillation Point is progressively decreased, progressively greater reductions in CO and hydrocarbons emissions will result;

2. As the olefin content is progressively decreased, progressively greater reductions in NOx and hydrocarbons emissions will result;

3. As the paraffin content is progressively increased, progressively greater reductions in CO and NOx emissions will result;

4. As the Reid Vapor pressure is progressively decreased, progressively greater reductions in NOx emissions will result;

5. As the Research Octane Number is progressively increased, progressively greater reductions in hydrocarbon emissions will result;

6. As the 10% D-86 Distillation Point is progressively decreased, progressively greater reductions in NOx emissions will result;

7. As the 90% D-86 Distillation Point is progressively decreased, progressively greater reductions in CO emissions will result.

And, of course, combining any of the above seven factors will lead to yet progressively greater reductions. However, as will become evident in light of the data in the examples to follow, the most important of the foregoing factors are Reid Vapor Pressure (for reducing NOx) and the 50% D-86 Distillation Point (for reducing CO and hydrocarbon emissions). Of secondary importance in reducing NOx are the olefin content and the 10% D-86 Distillation Point, with the former being of greater influence than the latter. The following Examples serve to further illustrate the inventive concept and are not intended to be construed as limitations on the invention, which is defined by the claims.

EXAMPLE 1

A total of 22 different unleaded gasoline fuels was tested in a 1988 Oldsmobile Regency 98 automobile equipped with a 3800 cc V-6 engine. This automobile was selected because it represented a high sales volume product with close to the current state-of-the-art emission technology. The emission system was closed loop control on the air to fuel ratio with a three way catalyst system and adaptive learning capability. The automobile had been previously driven for 38,000 miles to stabilize the Octane Requirement Increase.

The properties of each of the 22 fuels are shown in the following Table 2.

TABLE 2

| Blend Designation | Aromatics Vol. % by FIA | Olefins Vol. % by FIA | Paraffins Vol. % by FIA | GASOLINE PROPERTIES MTBE Vol. % by IR | Research Octane Number | Motor Octane Number | D86 Dist. 10% point (°F.) | D86 Dist. 50% point (°F.) | D86 Dist. 90% point (°F.) | Reid Vapor Pressure psi |
|---|---|---|---|---|---|---|---|---|---|---|
| AR3951-1 | 7.60 | 0.2 | 92.20 | 0.0 | 93.6 | 89.2 | 131 | 209 | 299 | 9.00 |
| AR3951-2 | 6.60 | 0.0 | 93.40 | 0.0 | 90.3 | 86.8 | 111 | 203 | 383 | 10.10 |
| AR3951-3 | 43.30 | 9.5 | 47.20 | 0.0 | 96.1 | 84.5 | 126 | 235 | 312 | 8.90 |
| AR3951-4 | 47.50 | 8.3 | 44.20 | 0.0 | 95.8 | 84.4 | 150 | 251 | 355 | 5.60 |
| AR3951-5 | 38.15 | 0.2 | 61.65 | 0.0 | 91.3 | 82.7 | 166 | 221 | 284 | 6.37 |
| AR3951-6 | 11.90 | 15.9 | 55.00 | 17.2 | 91.5 | 82.2 | 128 | 174 | 368 | 8.50 |
| AR3951-7 | 36.80 | 0.6 | 48.30 | 14.3 | 95.0 | 86.1 | 120 | 224 | 405 | 9.70 |
| AR3951-8 | 12.30 | 12.7 | 60.40 | 14.6 | 94.4 | 85.1 | 120 | 185 | 341 | 9.20 |
| AR3951-9 | 44.10 | 11.3 | 44.60 | 0.0 | 96.6 | 84.5 | 128 | 229 | 305 | 8.80 |
| AR3951-10 | 4.50 | 19.6 | 75.90 | 0.0 | 94.4 | 84.8 | 127 | 195 | 310 | 9.70 |
| AR3951-11 | 51.60 | 11.6 | 36.80 | 0.0 | 95.9 | 84.0 | 149 | 308 | 382 | 6.50 |
| AR3951-12 | 28.80 | 0.6 | 55.70 | 14.9 | 92.9 | 85.7 | 128 | 210 | 271 | 9.55 |
| AR3951-13 | 14.70 | 17.9 | 51.50 | 15.9 | 91.6 | 82.2 | 127 | 169 | 392 | 7.90 |
| AR3951-14 | 11.60 | 12.9 | 75.50 | 0.0 | 90.7 | 82.8 | 107 | 193 | 416 | 9.20 |
| AR3951-15 | 9.50 | 0.0 | 90.50 | 0.0 | 88.6 | 85.1 | 158 | 207 | 329 | 6.25 |
| ULRG | 58.30 | 0.4 | 30.40 | 10.9 | 107.0 | 95.7 | 160 | 218 | 229 | 5.35 |
| G3297-PJ | 40.90 | 11.1 | 48.00 | 0.0 | 96.4 | 85.2 | 120 | 214 | 339 | 8.20 |
| A/O 1111 | 19.50 | 4.1 | 76.40 | 0.0 | 90.6 | 84.4 | 123 | 196 | 282 | 8.80 |
| A/O 2222 | 48.30 | 21.0 | 15.40 | 15.3 | 99.0 | 86.1 | 125 | 221 | 356 | 8.80 |
| A/O AVE | 30.70 | 9.5 | 59.80 | 0.0 | 92.2 | 82.7 | 112 | 218 | 315 | 8.70 |
| ARCO EC-1 | 20.70 | 10.8 | 61.40 | 7.1 | 92.8 | 84.0 | 125 | 198 | 348 | 8.20 |
| SU2000E | 40 | 9 | 45.3 | 5.7 | 97.9 | 86.7 | 139 | 224 | 321 | 8.0 |

The fuels were tested in random order with no back to back runs of the same fuel. At first, only the 15 test fuels (designated AR3951-1 through AR3951-15) were run, in random order, and all more than once. However, every fifth run was conducted with fuel G3297-PJ as a control to evaluate systematic error. Each fuel was tested in accordance with the Federal Test Procedure except that (1) instead of allowing the engine between tests to cool down in still air for 10 to 12 hours at 68° to 86° F. (20.0° to 30.0° C.), the engine was subjected for 4.75 hours to a 70° F. (21.1° C.) wind of 50 miles per hour (80.5 km/hr) and (2) instead of a Clayton dynamometer, a General Electric dynamometer was used. It will be noted that the 15 test fuels were purposely blended to provide widely different values for the ten properties shown in Table 2. The emissions data derived from combusting the 15 different test fuels were then analyzed by computer program using the SAS system commercially available from SAS Institute Inc. In this program, the results of the runs with the 15 different fuels were regressed against each of the 10 variables shown in Table 2, as well as against all possible combinations thereof, searching for an equation for each of the three pollutants of interest (NOx, CO, and hydrocarbons) defined by the minimum number of variables that gives the best surface fit based on the R squared value. As a result, the Equations 4, 5, and 6 hereinbefore presented were derived as the equations which best define the amount of pollutants (in grams per mile) emitted as a function of the properties of the fuel combusted in the 1988 Regency vehicle.

After developing the foregoing equation, the other fuels shown in Table 2 were tested, most in multiple runs, and again with the G3297-PJ fuel being used in every fifth run. These fuels were tested for the purpose of checking the accuracy of the foregoing equations in forecasting emissions for new fuel, i.e., they were used as "check fuels."

The emissions data for all runs—the test, control, and check fuels—as well as the calculated emissions according to the foregoing developed equations, are tabulated in Table 3, with it being specifically noted that the order shown in Table 3 is not the exact order in which the fuels were tested.

TABLE 3

| Exp. | Fuel Designation | CO g/mile | NOx g/mile | HC g/mile | Calculated CO g/mile | Calculated NOx g/mile | Calculated HC g/mile |
|---|---|---|---|---|---|---|---|
| 1 | AR3951-1 | 1.106 | 0.196 | 0.100 | 1.593 | 0.203 | 0.131 |
| 2 | AR3951-2 | 0.948 | 0.186 | 0.094 | 1.638 | 0.201 | 0.127 |
| 3 | AR3951-3 | 1.590 | 0.264 | 0.145 | 2.226 | 0.271 | 0.179 |
| 4 | AR3951-4 | 2.228 | 0.252 | 0.193 | 2.458 | 0.235 | 0.194 |
| 5 | AR3951-5 | 2.034 | N.D. | 0.157 | 1.938 | 0.218 | 0.146 |
| 6 | AR3951-6 | 1.637 | 0.280 | 0.143 | 1.664 | 0.293 | 0.133 |
| 7 | AR3951-7 | 2.335 | 0.232 | 0.166 | 2.238 | 0.233 | 0.147 |
| 8 | AR3951-8 | 1.374 | 0.257 | 0.118 | 1.687 | 0.278 | 0.135 |
| 9 | AR3951-9 | 2.068 | 0.286 | 0.165 | 2.182 | 0.281 | 0.177 |
| 10 | AR3951-10 | 1.357 | 0.307 | 0.134 | 1.611 | 0.318 | 0.162 |
| 11 | AR3951-11 | 3.752 | 0.273 | 0.268 | 3.089 | 0.269 | 0.264 |
| 12 | AR3951-12 | 1.738 | 0.278 | 0.154 | 1.867 | 0.233 | 0.134 |
| 13 | AR3951-13 | 2.275 | 0.311 | 0.159 | 1.678 | 0.295 | 0.133 |
| 14 | AR3951-14 | 1.959 | 0.271 | 0.147 | 1.737 | 0.259 | 0.148 |
| 15 | AR3951-15 | 1.654 | 0.190 | 0.114 | 1.628 | 0.183 | 0.133 |
| 16 | ULRG | 1.901 | 0.200 | 0.142 | 2.096 | 0.208 | 0.127 |
| 17 | AR3951-14 | 1.708 | 0.255 | 0.156 | 1.737 | 0.259 | 0.148 |
| 18 | G3297-PJ | 2.267 | 0.273 | 0.187 | 2.059 | 0.262 | 0.160 |
| 19 | G3297-PJ | 1.784 | 0.254 | 0.167 | 2.059 | 0.262 | 0.160 |
| 20 | G3297-PJ | 1.975 | 0.288 | 0.160 | 2.059 | 0.262 | 0.160 |
| 21 | G3297-PJ | 2.265 | 0.263 | 0.180 | 2.059 | 0.262 | 0.160 |
| 22 | AR3951-1 | 1.269 | 0.200 | 0.137 | 1.593 | 0.203 | 0.131 |
| 23 | AR3951-1 | 1.535 | 0.200 | 0.135 | 1.593 | 0.203 | 0.131 |
| 24 | AR3951-2 | 1.253 | 0.163 | 0.133 | 1.638 | 0.201 | 0.127 |
| 25 | AR3951-3 | 1.692 | 0.244 | 0.148 | 2.226 | 0.271 | 0.179 |
| 26 | AR3951-4 | 2.835 | 0.274 | 0.235 | 2.458 | 0.235 | 0.194 |
| 27 | AR3951-5 | 1.764 | 0.250 | 0.159 | 1.938 | 0.218 | 0.146 |
| 28 | AR3951-6 | 1.338 | 0.268 | 0.115 | 1.664 | 0.293 | 0.133 |
| 29 | AR3951-7 | 2.059 | 0.223 | 0.146 | 2.238 | 0.233 | 0.147 |
| 30 | AR3951-8 | 1.633 | 0.271 | 0.140 | 1.687 | 0.278 | 0.135 |
| 31 | AR3951-9 | 1.952 | 0.281 | 0.157 | 2.182 | 0.281 | 0.177 |
| 32 | AR3951-11 | 3.443 | 0.237 | 0.272 | 3.089 | 0.269 | 0.264 |
| 33 | AR3951-12 | 1.959 | 0.266 | 0.146 | 1.867 | 0.233 | 0.134 |
| 34 | AR3951-13 | 2.127 | 0.320 | 0.156 | 1.678 | 0.295 | 0.133 |
| 35 | AR3951-14 | 2.552 | 0.284 | 0.182 | 1.737 | 0.259 | 0.148 |
| 36 | G3297-PJ | 2.240 | 0.263 | 0.204 | 2.059 | 0.262 | 0.160 |
| 37 | G3297-PJ | 2.059 | 0.240 | 0.168 | 2.059 | 0.262 | 0.160 |
| 38 | G3297-PJ | 2.322 | 0.278 | 0.172 | 2.059 | 0.262 | 0.160 |
| 39 | G3297-PJ | 1.890 | 0.286 | 0.169 | 2.059 | 0.262 | 0.160 |
| 40 | G3297-PJ | 2.339 | 0.252 | 0.192 | 2.059 | 0.262 | 0.160 |
| 41 | A/O 1111 | 1.641 | 0.296 | 0.173 | 1.579 | 0.222 | 0.129 |
| 42 | A/O 2222 | 1.999 | 0.251 | 0.172 | 2.417 | 0.345 | 0.189 |
| 43 | A/O AVE | 2.162 | 0.298 | 0.210 | 1.798 | 0.248 | 0.145 |
| 44 | A/O AVE | 2.476 | 0.274 | 0.167 | 1.798 | 0.248 | 0.145 |
| 45 | ARCO EC-1 | 1.651 | 0.271 | 0.139 | 1.810 | 0.257 | 0.146 |
| 46 | ARCO EC-1 | 1.517 | 0.255 | 0.139 | 1.810 | 0.257 | 0.146 |
| 47 | SU2000E | 1.738 | 0.203 | 0.166 | 2.104 | 0.256 | 0.164 |
| 48 | AR3951-15 | 1.511 | 0.244 | 0.152 | 1.553 | 0.172 | 0.125 |
| 49 | G3297-PJ | 1.862 | 0.284 | 0.161 | 2.059 | 0.262 | 0.160 |
| 50 | AR3951-5 | 2.012 | 0.261 | 0.201 | 1.938 | 0.218 | 0.146 |
| 51 | A/O 1111 | 1.545 | 0.293 | 0.224 | 1.579 | 0.222 | 0.129 |
| 52 | A/O 2222 | 1.963 | 0.246 | 0.157 | 2.417 | 0.345 | 0.189 |
| 53 | ULRG | 1.769 | 0.217 | 0.139 | 2.096 | 0.208 | 0.127 |

The multiple test emissions data for each of the check fuels and the control fuel were then averaged, set against the calculated values, the deviation from the calculated value then determined, and compared against the standard deviation, which in turn was calculated from only the data pertaining to the control fuel G3297-PJ. These data are set forth in the following Table 4:

TABLE 4

| Emis. | Fuel | Actual g/mi | Calculated g/mi | Deviation | Standard Deviation |
|---|---|---|---|---|---|
| CO | ULRG | 1.835 | 2.096 | 0.261 | 0.205 |

TABLE 4-continued

| Emis. | Fuel | Actual g/mi | Calculated g/mi | Deviation | Standard Deviation |
|---|---|---|---|---|---|
| CO | G3297-PJ | 2.127 | 2.059 | 0.067 | 0.205 |
| CO | Arco EC1 | 1.584 | 1.810 | 0.226 | 0.205 |
| CO | A/O 1111 | 1.593 | 1.579 | 0.014 | 0.205 |
| CO | A/O 2222 | 1.981 | 2.417 | 0.436 | 0.205 |
| CO | SU2000E | 1.738 | 2.104 | 0.366 | 0.205 |
| CO | A/O AVE | 2.319 | 1.798 | 0.521 | 0.205 |
| NOx | ULRG | 0.209 | 0.207 | 0.002 | 0.0162 |
| NOx | G3297-PJ | 0.266 | 0.261 | 0.005 | 0.0162 |
| NOx | Arco EC1 | 0.263 | 0.256 | 0.007 | 0.0162 |
| NOx | A/O 1111 | 0.295 | 0.222 | 0.073 | 0.0162 |
| NOx | A/O 2222 | 0.249 | 0.345 | 0.096 | 0.0162 |
| NOx | SU2000E | 0.203 | 0.256 | 0.053 | 0.0162 |
| NOx | A/O AVE | 0.286 | 0.248 | 0.038 | 0.0162 |
| HC | ULRG | 0.141 | 0.127 | 0.014 | 0.0142 |
| HC | G3297-PJ | 0.178 | 0.160 | 0.017 | 0.0142 |
| HC | Arco EC1 | 0.139 | 0.146 | 0.007 | 0.0142 |
| HC | A/O 1111 | 0.198 | 0.129 | 0.069 | 0.0142 |
| HC | A/O 2222 | 0.165 | 0.189 | 0.024 | 0.0142 |

TABLE 4-continued

| Emis. | Fuel | Actual g/mi | Calculated g/mi | Deviation | Standard Deviation |
|---|---|---|---|---|---|
| HC | SU2000E | 0.166 | 0.164 | 0.002 | 0.0142 |
| HC | A/O AVE | 0.189 | 0.145 | 0.044 | 0.0142 |

It will be seen that, in most cases, the deviations shown in Table 4 are well within three times the standard deviation. In turn, this means that the equations accurately define the scientific phenomena at work within normal realms of variabilities.

EXAMPLE 2

In this example, 22 gasoline fuels, including 15 test fuels A through N and P, one control fuel, Q, and six check fuels, R, S, T, V, W and X were run in six different automobiles. The properties of the 22 gasolines used are shown in the following Table 5.

TABLE 5

| Blend Designation | Aromatics Vol. % by FIA | Olefins Vol. % by FIA | Paraffins Vol. % by FIA | MTBE Vol. % by IR | Research Octane Number | Motor Octane Number | D86 Dist. 10% point (°F.) | D86 Dist. 50% point (°F.) | D86 Dist. 90% point (°F.) | Reid Vapor Pressure psi |
|---|---|---|---|---|---|---|---|---|---|---|
| | GASOLINE PROPERTIES | | | | | | | | | |
| A | 9.6 | 0.0 | 90.4 | 0.0 | 94.0 | 89.5 | 128 | 206 | 291 | 9.23 |
| B | 5.3 | 0.0 | 94.7 | 0.0 | 91.1 | 87.4 | 106 | 178 | 290 | 11.45 |
| C | 48.8 | 10.3 | 41.0 | 0.0 | 97.0 | 84.7 | 122 | 225 | 300 | 9.14 |
| D | 46.6 | 11.4 | 42.1 | 0.0 | 96.2 | 84.0 | 147 | 236 | 334 | 6.63 |
| E | 39.4 | 0.4 | 60.1 | 0.0 | 97.3 | 83.2 | 164 | 219 | 271 | 6.46 |
| F | 9.8 | 16.8 | 73.3 | 15.9 | 92.0 | 83.0 | 121 | 161 | 231 | 9.35 |
| G | 32.8 | 0.6 | 66.6 | 13.7 | 96.6 | 87.5 | 107 | 194 | 296 | 11.54 |
| H | 12.7 | 15.0 | 72.3 | 14.0 | 94.3 | 84.8 | 119 | 180 | 302 | 9.88 |
| I | 46.4 | 12.6 | 41.0 | 0.0 | 97.3 | 84.9 | 126 | 220 | 294 | 8.73 |
| J | 4.8 | 6.2 | 89.1 | 0.0 | 93.9 | 84.9 | 119 | 188 | 290 | 9.65 |
| K | 45.6 | 13.6 | 40.8 | 0.0 | 95.9 | 83.9 | 135 | 274 | 370 | 7.60 |
| L | 31.0 | 0.2 | 68.8 | 14.4 | 93.3 | 85.6 | 125 | 206 | 262 | 9.43 |
| M | 15.9 | 15.3 | 68.8 | 15.8 | 92.1 | 82.9 | 114 | 157 | 368 | 9.77 |
| N | 12.8 | 11.6 | 75.6 | 0.0 | 90.7 | 83.2 | 107 | 185 | 403 | 10.51 |
| P | 10.6 | 0.0 | 89.4 | 0.0 | 89.7 | 85.8 | 144 | 204 | 318 | 7.07 |
| Q | 31.8 | 9.9 | 58.3 | 0.0 | 92.1 | 82.7 | 129 | 220 | 331 | 8.31 |
| R | 52.0 | 21.9 | 26.1 | 14.6 | 98.8 | 85.5 | 130 | 224 | 358 | 8.37 |
| S | 21.1 | 3.9 | 75.0 | 0.0 | 91.0 | 84.3 | 129 | 199 | 284 | 8.44 |
| T | 30.2 | 0.0 | 69.8 | 0.0 | 88.5 | 81.2 | 127 | 182 | 293 | 8.00 |
| V | 23.3 | 6.0 | 70.7 | 0.0 | 92.0 | 83.5 | 132 | 196 | 319 | 7.96 |
| W | 25.6 | 11.8 | 62.5 | 10.1 | 97.7 | 86.7 | 134 | 215 | 335 | 8.12 |
| X | 38.5 | 0.0 | 61.5 | 0.0 | 94.8 | 85.0 | 123 | 211 | 326 | 7.63 |

The automobiles (and accompanying engines) utilized were:

1. 1988 Oldsmobile 98 Regency—3.8 liter V-6
2. 1989 Ford Taurus—3.0 liter V-6
3. 1990 Toyota Camry—2.0 liter 4 cylinders
4. 1989 GM Cutlass Calais—3.8 liter V-6
5. 1990 Ford Lincoln—5.0 liter V-8
6. 1990 Dodge Shadow—2.5 liter 4 cylinders The fuels were tested in the foregoing automobiles in the same manner as described in Example 1 except that the control fuel was used in every sixth run and the Federal Test Procedure (FTP) was followed exactly. Each fuel was tested at least twice, many three times, and some four times, in each of the vehicles.

Figure 2:
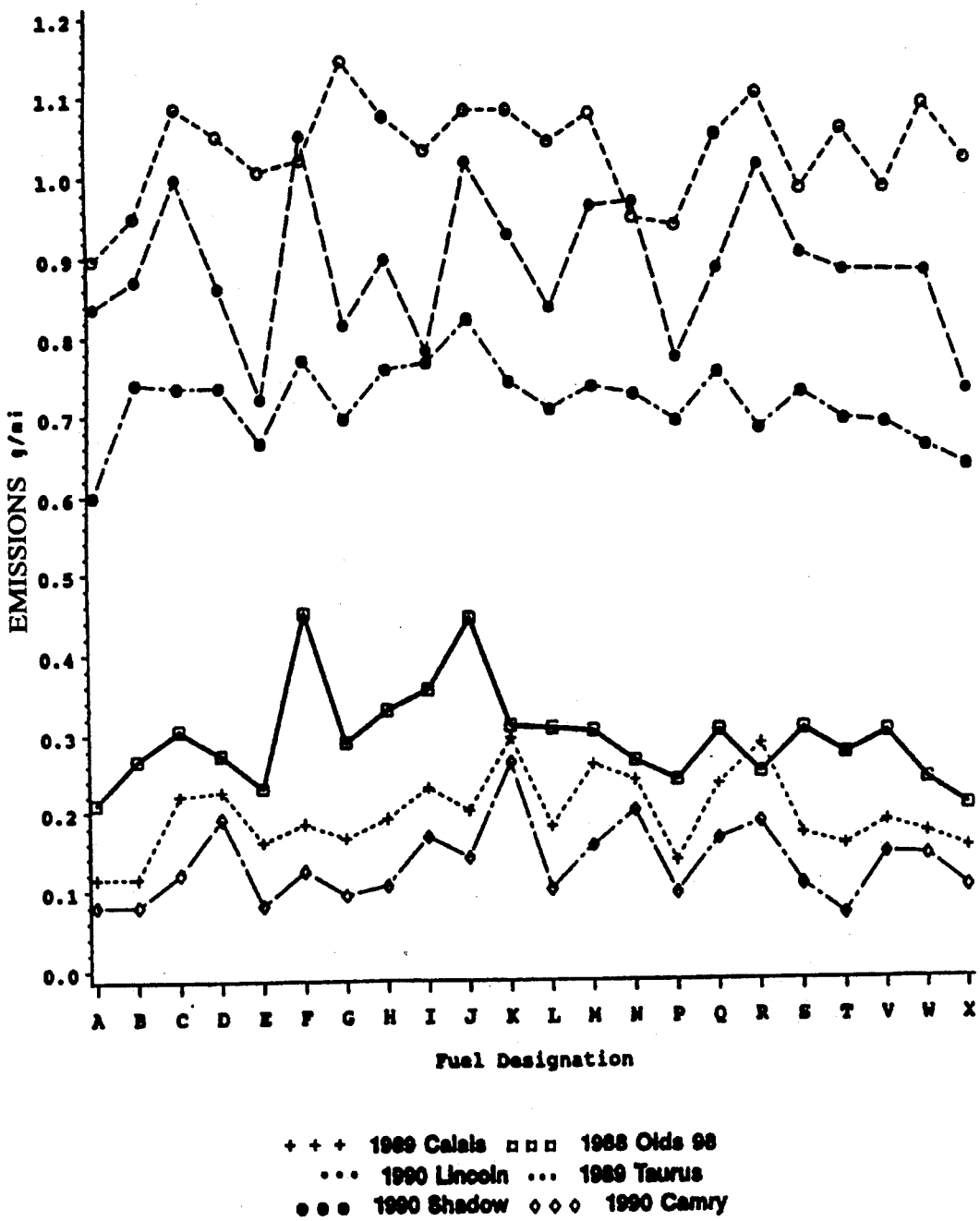
FIG. 2 is a graph of NOx emission values for 22 different fuels tested in six different automobiles. Each data point on the graph is an average of a plurality of runs for each fuel-automobile combination.
Figure 3:
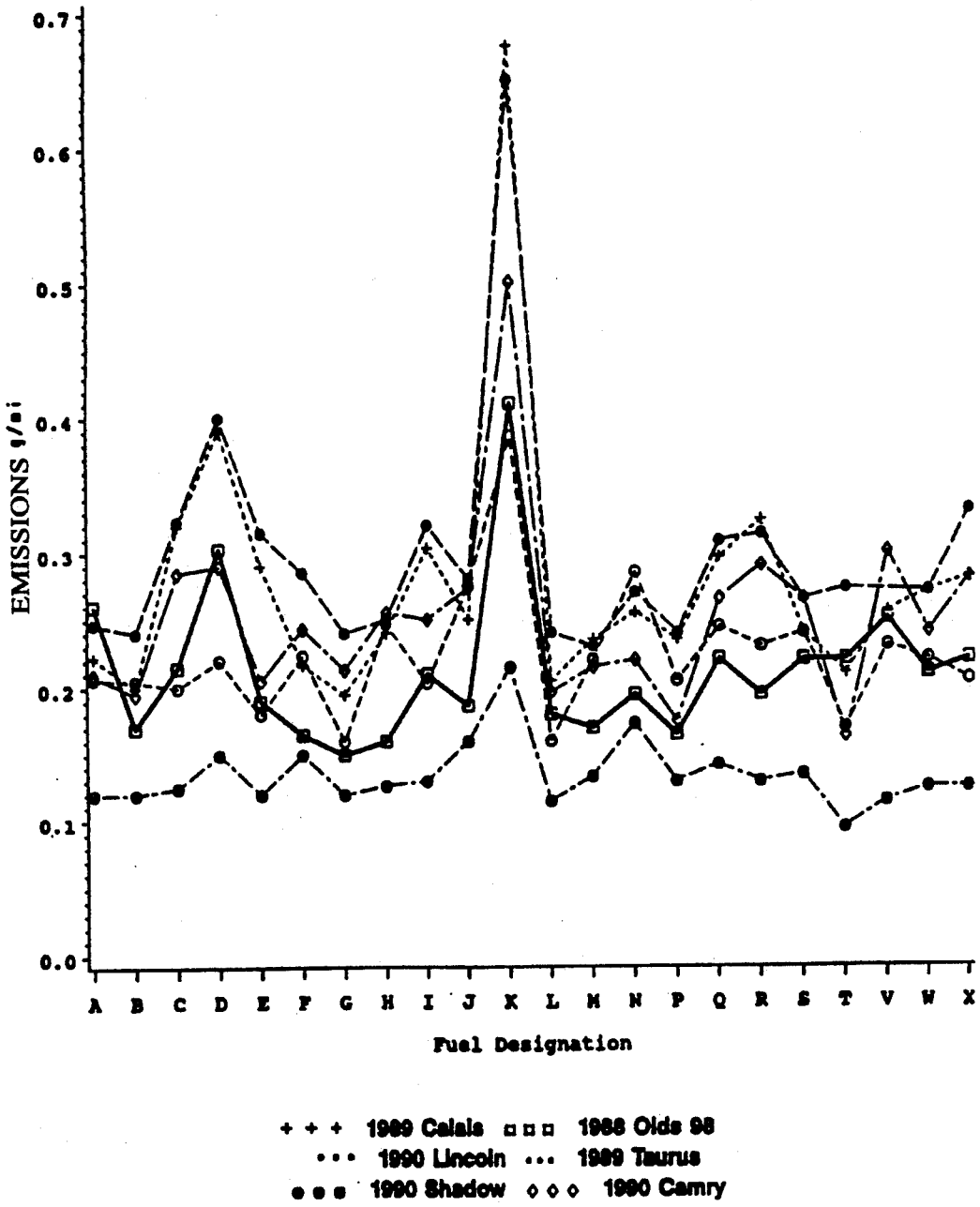
FIG. 3 is a graph of hydrocarbon emission values for 22 different fuels tested in six different automobiles. Each data point on the graph is an average of a plurality of runs for each fuel-automobile combination.

The CO, NOx, and hydrocarbon emission data obtained by the Federal Test Procedure for each fuel in a given automobile were averaged, and then plotted respectively in the graphs in FIGS. 1, 2, and 3. (Thus, each data point in FIGS. 1 through 3 is an average of the values obtained for each automobile with the specified fuel.) Given the great number of fuels and automobiles tested, each of the three graphs shows a remarkable similarity in the overall shape of the curves in the graphs. It is clearly evident from these figures that the general effect of a given fuel is the same for different vehicles, with only the magnitude of the effect varying.

EXAMPLE 3

In this example, Example 2 was repeated except on the following automobiles (and accompanying engines):

1. 1985 Ford Tempo—2.3 liter 4 cylinders
2. 1984 GM Caprice—5.0 liter V-8
3. 1988 Honda Accord—2.0 liter 4 cylinders
4. 1985 GM Suburban—5.7 liter V-8

Figure 4:
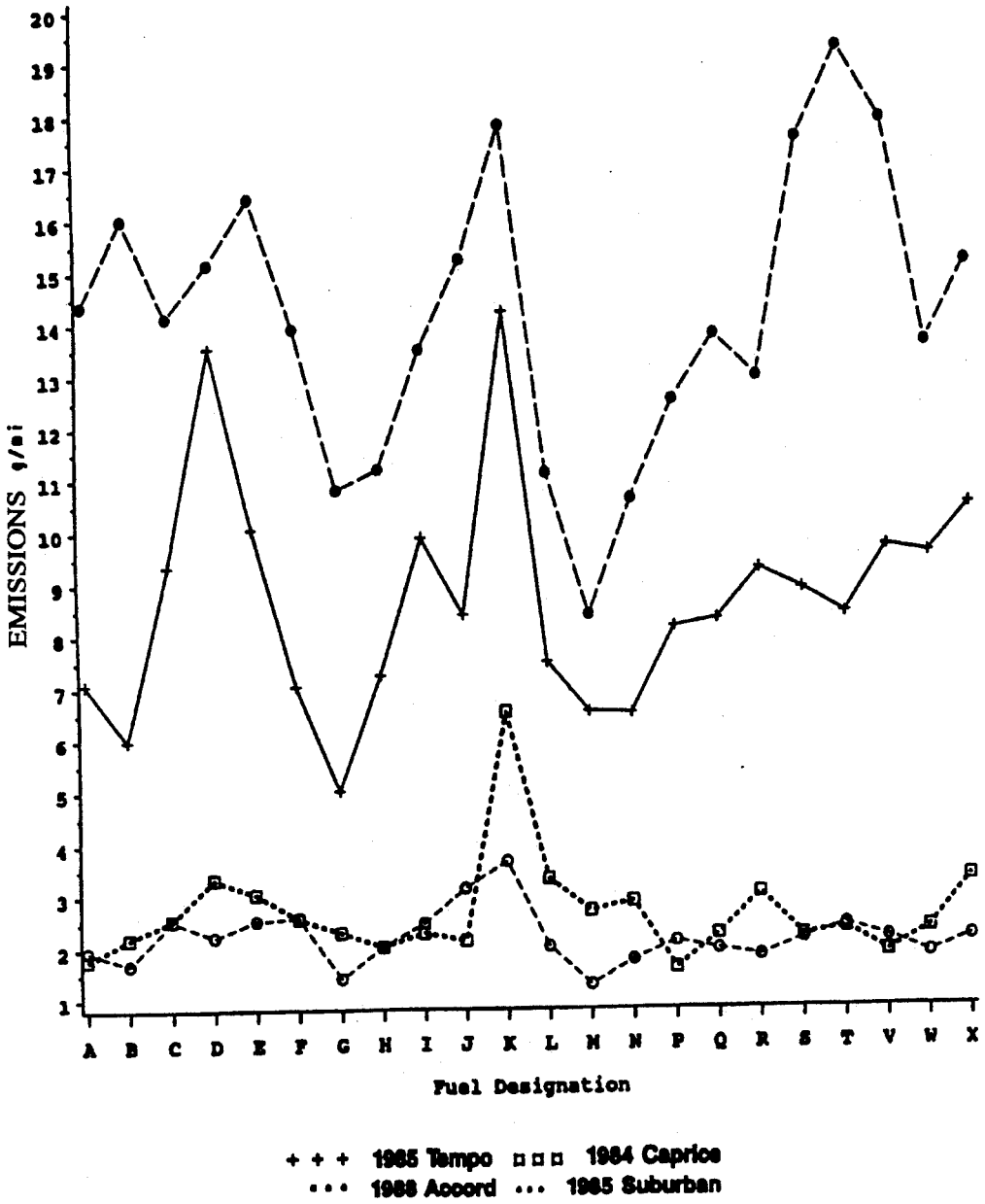
FIG. 4 is a graph of CO emission values for 22 different fuels tested in four different automobiles. Each data point on the graph is an average of a plurality of runs for each fuel-automobile combination.
Figure 5:
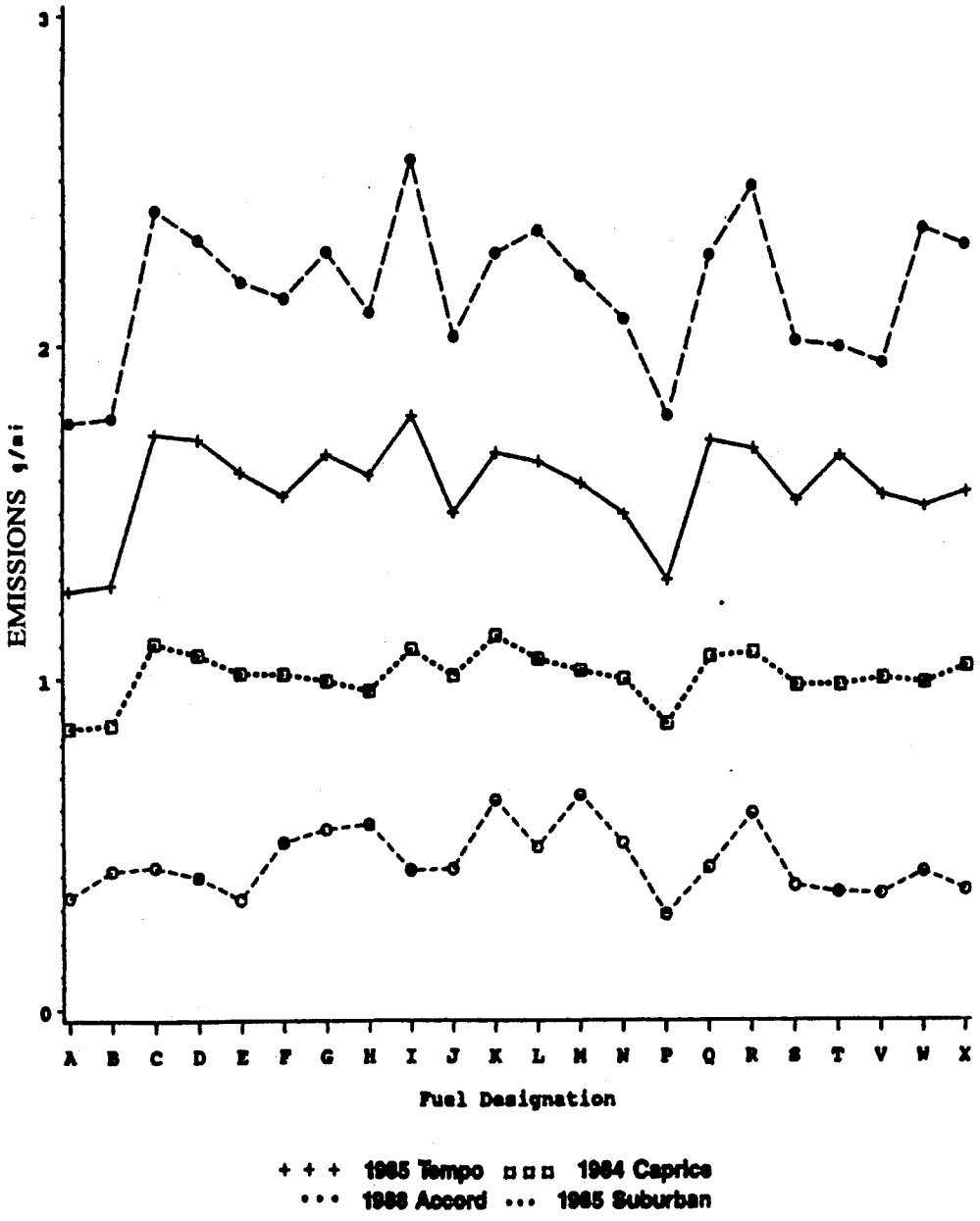
FIG. 5 is a graph of NOx emission values for 2 different fuels tested in four different automobiles. Each data point on the graph is an average of a plurality of runs for each fuel-automobile combination.
Figure 6:
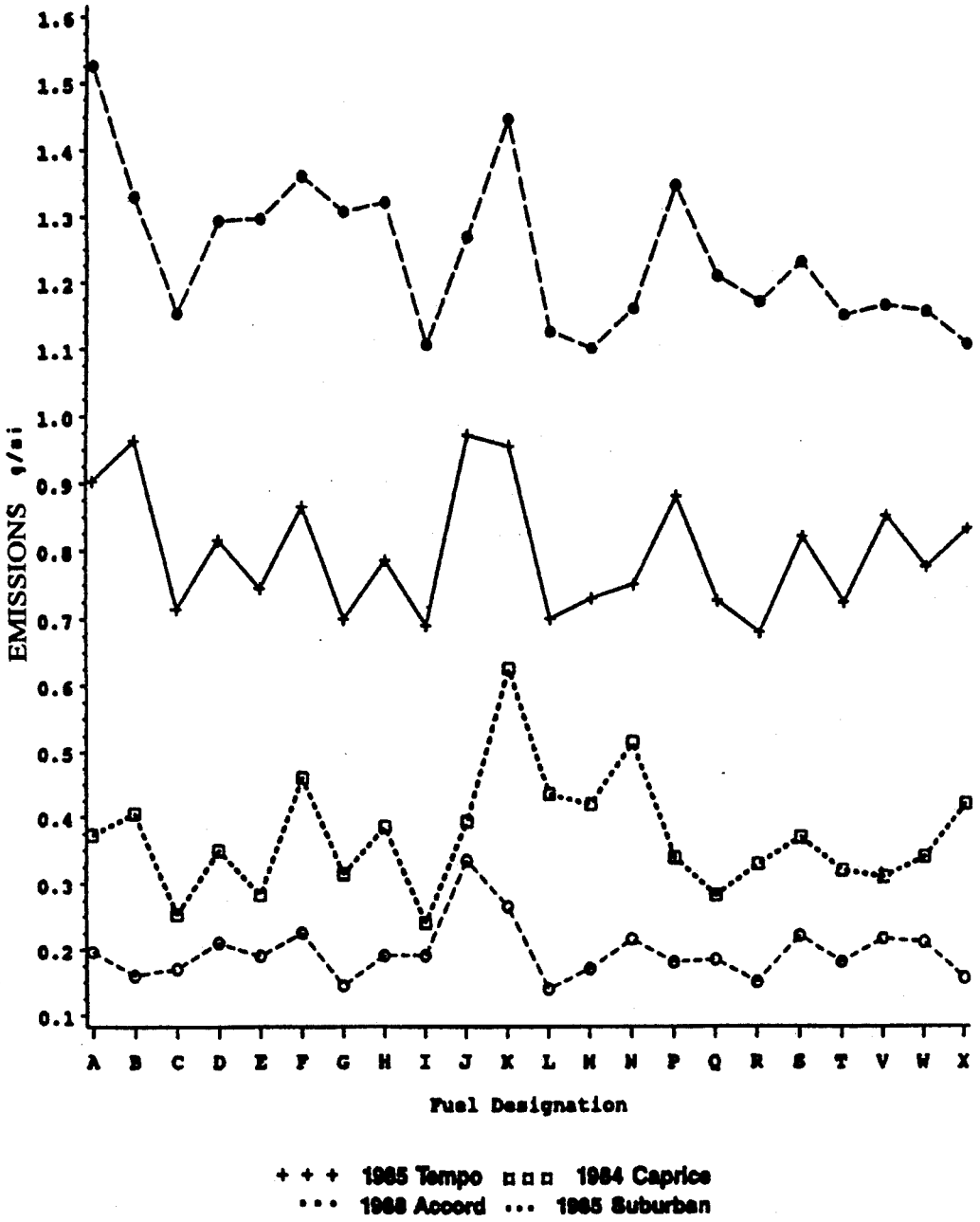
FIG. 6 is a graph of hydrocarbon emission values for 22 different fuels tested in four different automobiles. Each data point on the graph is an average of a plurality of runs for each fuel-automobile combination.

The fuels were tested in the foregoing automobiles in the same manner as described in Example 2. The emission data obtained were averaged and plotted on FIGS. 4 through 6, and once again, the results show a remarkable consistency in the effects of a given fuel.

In all, for Examples 2 and 3, a total of over 500 FTP runs was made so as to provide a large enough data base to ensure the validity of the results. It should be noted that Examples 2 and 3, and the figures of the drawing pertaining to each, focused on automobiles and engines which were dissimilar in many respects. However, the automobiles in Example 2 all had adaptive learning computers with fuel-to-air feedback control loops whereas those in Example 3 did not. The figures thus show that groups of cars with these similar engineering features behave similarly to changes in the fuel, which in turn shows the universality of one of the inventive concepts. The automobiles of Examples 2 and 3 were chosen because of their high commercial sales. The automobiles of Example 2 were all relatively recent models while those of Example 3 were generally older. All but one of the Example 3 automobiles had carburetor systems whereas all of those in Example 2 had fuel injection systems.

The data derived in Examples 2 and 3 were analyzed by the same computer program as described for Example 1, searching, as in Example 1, for an equation for each automobile which would provide a value for NOx, CO, and hydrocarbon emissions as a function of the minimum number of fuel properties. Not every equation so derived conformed to the generalized equation set forth hereinbefore; some, for example, showed a minor increase in hydrocarbon emissions with increases in aromatics content. Nevertheless, many of the equations did fit the generalized equation set forth hereinbefore, and more importantly, the data overall validated the fact that the most important factors as shown in the generalized Equations 1 to 3 proved almost universally most significant for each automobile.

More specifically, where much of the previous discussion was limited to 1988 Oldsmobile Regency 98 and similar automobiles, the data in tables 7 to 9—which were obtained from the data from which FIGS. 1 to 6 were derived—indicate that some variables universally or essentially universally affect emissions from automobile engines, others are limited to one or only a few vehicles, and yet others affect a particular pollutant in about 50% of the vehicles.

More specifically still, in the tables of FIGS. 7 to 9 there are indicated for each automobile tested in Examples 2 and 3 those factors which proved to be significant in increasing the specified emission when the variable is increased (as indicated by one or more + signs) and significant in decreasing the specified emission when the variable is increased (as indicated by one or more − signs). Those variables which dramatically affect emissions (i.e., principal factors) are indicated by more than one + or − signs, with increasing numbers of + or − signs indicating increased significance for that variable. Those variables which are of least importance among the significant variables are indicated by a (+) or (−) sign. (Also shown in FIGS. 7 to 9 are the values obtained by summing the square of all the data predicted by the particular equation for each automobile for a particular pollutant and dividing by the sum of the square of all the data actually obtained for the automobile. It will be recognized that, the closer such value is to 1.0, the better the equation defines the effect under consideration. In the case of FIGS. 7 to 9, 29 of the 30 values are above 0.9 and only one is below—and that scarcely below at 0.894. Accordingly, it was determined that the equations for each of the automobiles was statistically accurate, and that therefore the data derived therefrom—as shown in FIGS. 7 to 9—would meaningfully point to those variables which would have a statistically significant effect upon the emission characteristics from a given automobile in FIGS. 7 to 9.)

When the data of Examples 2 and 3 are analyzed as shown in FIGS. 7 to 9, the following facts stand out as most significant:

1. Decreases in the 50% D-86 Distillation Point caused decreases in CO and hydrocarbon emissions for all of the automobiles.

2. Decreases in the Olefin Content caused reductions in NOx emissions from all the vehicles.

3. Decreases in the 10% D-86 Distillation Point caused reductions in NOx emissions from all the vehicles.

4. Decreases in Reid Vapor Pressure caused reductions in NOx emissions from all the vehicles but one.

Accordingly, from the data in FIGS. 7 to 9, it can be seen that for automobiles in general that decreasing any of the variables 1 to 4 above will have a positive effect, especially for any large population of automobiles. In turn, it can be appreciated that the preferred fuels of the invention will be prepared (e.g., by appropriate blending in a refinery) so as to decrease each of the foregoing variables, and in particular, the 50% D-86 Distillation Point, the Reid Vapor Pressure, and the Olefin content, all three of which are more significantly (and easily) decreasable in refinery practice than the 10% D-86 distillation Point.

Presently, the most commercially attractive fuel producible in accordance with the invention has the following properties: (1) Olefin Content of 0%; (2) Reid Vapor Pressure of 7.5 psi (0.51 atm) maximum; and (3) 50% D-86 distillation point greater than 180° F. (82° C.) but no greater than 205° F. (96° C.).

Where it is desired to take advantage of the emission reductions attainable by varying the 50% D-86 distillation point, this value usually is no greater than 215° F. (101.6° C.), e.g., no greater than 210° F. (98.9° C.) but preferably is no greater than 205° F. (96.1° C.), e.g., less than 203° F. (95° C.), or less than 200° F. (93.3° C.), or less than 198° F. (92.2° C.), more preferably less than 195° F. (90.6° C.), e.g., less than 193° F. (89.4° C), or less than 190° F. (87.8° C.), or less than 187° F. (86.1° C.), and most preferably less than 185° F. (85.0° C.), e.g., less than 183° F. (83.9° C.). In general, the 50% D-86 Distillation Point is above 170° F. (77° C.) and most often above 180° F. (82.2° C.)

Where it is desired to take advantage of the emission reductions attainable by varying the olefin content, this value is generally maintained less than 15 volume percent, with decreasing values providing progressively improved results. Thus, it is contemplated that each unit reduction, e.g., to values below 14, below 13, below 12, below 11, below 10, below 9, below 8, below 7, below 6, below 5, below 4, below 3, below 2, below 1 providing progressively better results, with values of 0.5 or less and essentially zero providing the best results possible.

Where it is desired to take advantage of reductions attainable by reducing the Reid Vapor Pressure, the gasoline will generally have a Reid Vapor Pressure specification of 8.0 psi (0.54 atm) max., most often less than 8.0 psi (0.54 atm), preferably no greater than 7.5 psi (0.51 atm), even more preferably no greater than 7.0 psi (0.48 atm), and most preferably of all, no greater than 6.5 psi (0.44 atm).

Where the emissions reductions attainable by reducing the 10% D-86 Distillation Point is desired, this value is most often maintained no greater than 140° F. (71° C.), preferably no more than 135° F. (57.2° C.), even more preferably no more than 130° F. (54° C.), and most preferably of all, no more than 122° F. (48.9° C.).

It can also be seen from the data in FIG. 7 that the paraffin content has an effect on 50% of the automobiles with respect to reducing CO, i.e., progressively increasing the paraffin content progressively decreases the CO emitted. Accordingly, where it is desired to take advantage of these facts, the paraffin content would be increased to above 40 volume percent, usually above 50 volume percent, most often to above 65 volume percent, preferably above 68 volume percent, more preferably above 70 volume percent, e.g., above 72 volume percent, even more preferably above 75 volume percent, e.g., above 77 volume percent, and most preferably, above 80 volume percent, e.g., above 82 volume percent, and most preferably of all, above 85 volume percent, e.g., above 87 or 90 volume percent.

Likewise, 60% of the automobiles shown in FIG. 9 evidenced reductions in hydrocarbon emissions when the aromatics content was increased. Where it is desired to take advantage of this fact, the aromatics content would be increased to at least 35 volume percent, preferably at least 40 volume percent.

In view of the information presented above, a petroleum refiner may take advantage of the invention by blending hydrocarbon streams boiling in the gasoline range of 77° F. (25° C.) to about 437° F. (225° C.) so as to affect at least one (and preferably more than one) of the properties of one of the streams as follows:

(1) decrease the 50% D-86 Distillation Point;
(2) decrease the olefin content;
(3) increase the paraffin content;
(4) decrease the Reid Vapor pressure;
(5) increase the Research Octane Number;
(6) decrease the 10% D-86 Distillation Point;
(7) decrease the 90% D-86 Distillation Point; and
(8) increase the aromatics content.

In such case, the petroleum refiner is, in essence, using the information provided by the present invention so as to convert a given gasoline stream into another with better properties with respect to CO, NOx, and/or hydrocarbon emissions.

It will also follow that one can increase or decrease any combination of the eight properties listed above, i.e., at least two, at least three, at least four, etc., of the properties can be increased or decreased in the direction indicated above, as well as all eight. In addition, the greater any individual property is changed in the direction indicated, the better the result, with at least 10% changes being normally used, and preferably at least 20%. In addition, one can change the property by difference instead of by percentage, for example, affecting the properties as follows:

(a) decreasing the 50% D-86 distillation point by at least 20° F. (11.1° C.) or by at least 40° F. (22.1° C.);
(b) decreasing the Reid Vapor Pressure by at least 1 psi (0.07 atm.) or by at least 2 psi (0.14 atm.);
(c) decreasing the olefin content by at least 3 volume percent or by at least 5 volume percent;
(d) increasing the paraffin content by at least 10 volume percent by at least 20 volume percent.
(e) decreasing the 10% D-86 distillation point by at least 10° F. (5.5° C.) or by at least 20° F. (11.1° C.); and
(f) increasing the aromatics content by at least 10 volume percent. Moreover, as would stand to reason, one could also elect to employ any combination of (a) to (f) above to produce the desired lower emission gasoline product.

While the invention may be used to advantage even on a small volume basis, e.g., a single automobile operating with a fuel composition of the invention for a week or for at least 200 consecutive miles, it is clear that the benefits offered by the invention are best taken advantage of when a large number of automobiles operating with spark induced internal combustion engines requiring a gasoline fuel are powered with the fuel of the invention. In fact, the benefits of the invention increase directly with the number of automobiles which employ the fuel. Therefore, in one embodiment of the invention, on a given day, and preferably on a daily basis over a period of at least one month, at least 1,000 and more preferably at least 10,000 automobiles are provided with a fuel composition of the invention—and even more preferably it is desired that the 1000+ or 10,000+ automobiles be provided with such fuel in a highly congested area, e.g., within the limits of a city or county encompassing a population of 500,000 or more people. Most advantageously, the amount of fuel dispensed into automobile fuel tanks within the city or county should be sufficient to effect a noticeable decrease in the amount of one or more of NOx, CO, and hydrocarbons in the air. At the present time, it is believed that, if as little as 10% of the gasoline fuel supplied to automobiles within a given city or county were a composition of the invention, a decrease in the pollution caused by one or more of these components would be obtained (assuming no significant increase in the automobile traffic within said city or county). Higher percentages, e.g., at least 25%, will yield still better results. If at least 50% of the fuel sold within a given city or county on a daily basis were a composition of the invention, it is believed, based on the data in the Examples hereinabove, that reductions in auto emissions of CO, NOx, and/or hydrocarbons at least as high as 20% as compared to the typical gasoline fuel could be observed (depending, of course, on how each of the variables is adjusted in the appropriate direction and the magnitude of such changes). Yet better results can be expected if at least 75%, even more preferably at least 90%, of the gasoline fuel were supplied on a given day from gasoline service stations within a given geographical area, e.g., a governmental district such as a city or county. Alternatively, if the same percentages pertained to a specific unit area, e.g., any 5,000 square mile (12,948 square kilometer) or 10,000 square mile (25,895 square kilometer) or any 50,000 square mile (129,476 square kilometer) area, one would expect to see reductions in one or more of CO, NOx, and hydrocarbons.

In any event, because the benefits of the invention are best realized when the gasoline fuel of the invention is supplied and combusted on a large quantity basis (i.e., large volume consumption), it is contemplated that there are many ways by which this can be accomplished, among which the following are merely illustrative:

1. Operating a fleet of automotive vehicles, numbering at least 10, preferably at least 25, with a fuel composition of the invention.
2. Operating a single automobile for an extended period of time, e.g., at least six months, or for at least 2,000 consecutive miles (3,218 kilometers), with a fuel composition of the invention.
3. Consuming at least 500 gallons (1,893 liters) of a fuel composition of the invention in one vehicle.
4. Consuming at least 2,000 gallons (7,570 liters) of a fuel composition of the invention in either one automobile or a fleet of automobiles.

Yet greater consumption can be attained by, for example:

1. Supplying, via gasoline service stations and the like, at least 1,000 vehicles, preferably at least 10,000 vehicles, per day with a fuel composition of the invention.
2. Supplying, via gasoline service stations and the like, at least 10,000,000 gallons (37,850,000 liters) per week of a fuel composition of the invention to automotive vehicles.

In order to supply and consume a gasoline composition of the invention on a large volume basis, it follows that the gasoline composition must be produced at a petroleum refinery or the like in large volumes. Typically, a refinery has a capacity to process at least 20,000 barrels per day (132,500 liters per hour), preferably at least 30,000 barrels per day (198,750 liters per hour), of crude oil and to produce at least 30,000 gallons (113,550 liters), preferably at least 50,000 gallons (189,250 liters), and most preferably at least 100,000 gallons (378,500 liters) of gasoline per day. While the invention would best be taken advantage of if all the gasoline fuel produced in a refinery were a composition of the invention, good results can be obtained if a significant fraction thereof—e.g., at least 10%, were a fuel composition of the invention. In commercial practice, it is contemplated that usual procedures will result in at least 25%, often at least 50%, and sometimes at least 75% of the daily refinery output being a fuel composition of the invention. Such output would then be delivered to gasoline service stations for introduction into automobiles, with, again, the greatest significant advantage being if all the gasoline service stations so supplied—or some significant portion thereof, e.g., at least 25%, more preferably at least 50%, and most preferably at least 75%—are located in a congested area of high population density, e.g., a city or county as described above.

Accordingly, in view of the foregoing, it will be seen that there are many ways of employing the inventive concept on a large volume basis. Obviously, the best results will be obtained when the fuel composition of the invention is so blended in a refinery or the like as to reduce the emissions of hydrocarbons, CO, and NOx to the lowest possible levels, then combusting such fuel in automobiles on a large volume basis over extended periods of time, e.g., at least one month, preferably at least six months, and with the most advantage to be realized in the most densely populated areas, e.g., counties or cities of populations exceeding 1,000,000, or more than 2,500,000, or more than 5,000,000, or, in areas like Los Angeles county, more than 10,000,000 persons. To provide for the needs of such high population density areas, it may be necessary to supply the fuel composition of the invention from more than one refinery, and to deliver it to a large fraction of the gasoline service stations in such area, e.g., at least 25%, preferably at least 50%, most preferably at least 75%, so that a large number of automobiles can be supplied with the inventive fuel on a daily basis, e.g., at least 100,000, preferably at least 500,000 automobiles.

In view of the foregoing, it can be seen that the invention offers many advantages, not the least of which are the obvious health benefits associated with reduced air pollutants emitted to the atmosphere from automobiles, trucks, and other gasoline powered motor vehicles. Additionally, the invention can be put into immediate practice; current refining equipment can be employed to produce the low polluting fuels of the invention. Moreover, the invention offers the petroleum refiner a great deal of flexibility, for the invention is highly adaptable to a wide variety of hydrocarbon refinery streams. More specifically, since the description hereinbefore shows the effect of different variables, the refiner is not constrained to producing one particular fuel, but has several options, depending on what hydrocarbon streams are at hand and what properties of the fuel can be most easily altered.

By offering such flexibility with no needed hardware changes in a refinery, the invention is relatively easy to implement—and all the more so in light of the fact that the invention can be taken advantage of without need for additives specific for reducing polluting emissions. As an example, many current fuels contain methyl tertiary butyl ether as an additive for reducing CO emissions. The present invention, however, requires no methyl tertiary butyl ether to be present. Thus, while the invention in its broadest embodiment encompasses fuels with additives that may aid in reducing such emissions, the advantages of the invention can be obtained without the necessity, for example, of a refinery having to deliberately change its practices to provide for the continuous blending of an emission-reducing additive into the fuel.

The invention, of course, as described hereinbefore, offers significant reductions in NOx, CO, and hydrocarbon emissions. Present indications are that, on a side-by-side basis, preferred fuels of the present invention offer at least a 10%, usually at least a 20%, sometimes at least 40%, reduction in emissions when tested in identical vehicles (e.g., the 1988 Oldsmobile Regency 98 described above) with identical engines and identical catalytic converter systems as compared to results obtained with a typical fuel, for example, the fuel identified in Table 2 as A/O AVE and that in Table 5 as Fuel Q. (These fuels are, in essence, identical, having been made in identical fashion but at different times; the slight differences in results shown in the two tables being within normal tolerance variations.)

It should also be recognized that the invention offers an advantage for automobile manufacturers. As government regulations progressively become more stringent in the amount of pollutants that can be emitted from motor vehicles, the present invention, by providing for a fuel inherently having properties which reduce or minimize such emissions, allows an automobile manufacturer to meet such regulations with fewer—if any—hardware design changes being needed.

It will be understood that reference hereinabove to the "D-86 Distillation Point" refers to the distillation point obtained by the procedure identified as ASTM D 86-82, which can be found in the 1990 Annual Book of ASTM Standards, Section 5, Petroleum Products, Lubricants, and Fossil Fuels, herein incorporated by reference in its entirety.

The FTP (Federal Test Procedure) specified hereinabove refers to Code of Federal Regulations, volume 40, "Protection of the Environment," Subpart B, "Emission Regulations for 1977 and Later Model Year New Light-Duty Vehicles and New Light-Duty Trucks; Test Procedures, herein incorporated by reference in its entirety.

"Reid Vapor Pressure" is a pressure determined by a conventional analytical method for determining the vapor pressure of petroleum products. In essence, a liquid petroleum sample is introduced into a chamber, then immersed in a bath at 100° F. (37.8° C.) until a constant pressure is observed. Thus, the Reid Vapor Pressure is the difference, or the partial pressure, produced by the sample at 100° F. (37.8° C.). The complete test procedure is reported as ASTM test method D 323-89 in the 1990 Annual Book of ASTM Standards, Section 5, Petroleum Products, Lubricants, and Fossil Fuels, herein incorporated by reference in its entirety.

While the invention has been described in conjunction with preferred embodiments thereof, various modifications and substitutions can be made thereto without departing from the spirit and scope of the present invention. The invention has also been described with reference to examples, which are presented for illustration only, and thus no limitation should be imposed other than those indicated by the following claims:

We claim:

1. An unleaded gasoline fuel, suitable for combustion in an automotive engine having the following properties:

(1) a 50% D-86 distillation point no greater than 205° F.; and (2) a Reid Vapor Pressure less than 7.5 psi.

2. An unleaded gasoline fuel as defined in claim 1 having an olefin content less than 10 percent by volume.

3. An unleaded gasoline fuel as defined in claim 2 having a 50% D-86 distillation point no greater than 204° F.

4. An unleaded gasoline fuel as defined in claim 3 comprising at least 65 percent by volume paraffins.

5. An unleaded gasoline fuel as defined in claim 3 wherein the olefin content is less than 5.0 volume percent and the 50% D-86 Distillation Point is greater than 180° F. (82° C.).

6. An unleaded gasoline fuel as defined in claim 5 wherein the olefin content is less than 0.5 volume percent.

7. An unleaded gasoline fuel as defined in claim 5 wherein the olefin content is essentially zero.

8. An unleaded gasoline fuel as defined in claim 2 wherein the 50% D-86 distillation point is less than 205° F.

9. An unleaded gasoline fuel as defined in claim 2 wherein the 50% D-86 distillation point is no greater than 203° F.

10. An unleaded gasoline fuel as defined in claim 9 wherein the paraffin content is greater than 75 volume percent.

11. An unleaded gasoline fuel as defined in claim 9 wherein the olefin concentration is less than 5 volume percent.

12. An unleaded gasoline fuel as defined in claim 2 wherein the Reid Vapor Pressure is no greater than 7.2 psi.

13. An unleaded gasoline fuel as defined in claim 2 wherein the Reid Vapor pressure is no greater than about 7.0 psi.

14. An unleaded gasoline fuel as defined in claim 1 wherein the 50% D-86 distillation point is less than 204° F.

15. An unleaded gasoline fuel as defined in claim 14 wherein the olefin concentration is less than 2 volume percent.

16. An unleaded gasoline fuel as defined in claim 1 wherein the 50% D-86 distillation point is no greater than 203° F.

17. An unleaded gasoline fuel as defined in claim 16 wherein the olefin concentration is less than 1 volume percent.

18. An unleaded gasoline fuel as defined in claim 17 wherein the olefin concentration is less than 0.5 volume percent.

19. An unleaded gasoline fuel as defined in claim 18 wherein the 50% D-86 distillation point is greater than 180° F. (82.2° C.).

20. An unleaded gasoline fuel as defined in claim 19 wherein the paraffin content is above 75 volume percent.

21. An unleaded gasoline fuel as defined in claim 19 wherein the olefin concentration is essentially zero volume percent.

22. An unleaded gasoline fuel as defined in claim 16 wherein the Reid Vapor Pressure is no greater than 7.3 psi.

23. An unleaded gasoline fuel as defined in claim 16 wherein the Reid Vapor Pressure is no greater than about 7.0 psi (0.48 atm).

24. An unleaded gasoline fuel as defined in claim 1 wherein the Reid Vapor Pressure is no greater than 7.4 psi.

25. An unleaded gasoline fuel as defined in claim 24 wherein the 50% D-86 Distillation Point is no more than 204° F.

26. An unleaded gasoline fuel as defined in claim 1 wherein the Reid Vapor Pressure is no greater than 7.3 psi.

27. An unleaded gasoline fuel as defined in claim 26 wherein the 50% D-86 Distillation Point is no more than 204° F.

28. An unleaded gasoline fuel as defined in claim 1 wherein the Reid Vapor Pressure is no greater than 7.1 psi.

29. An unleaded gasoline fuel as defined in claim 28 wherein the 50% D-86 distillation point is no greater than 203° F.

30. An unleaded gasoline fuel, suitable for combustion in an automotive engine, having an olefin content less than 3.0 volume percent, a 50% D-86 distillation point no greater than 205° F., and a Reid Vapor Pressure less than 7.6 psi.

31. An unleaded gasoline fuel as defined in claim 30 wherein the Reid Vapor Pressure is no greater than 7.0 psi.

32. An unleaded gasoline fuel as defined in claim 1 wherein the Reid Vapor Pressure is no greater than about 7.0 psi (0.51 atm).

33. An unleaded gasoline fuel as defined in claim 32 wherein the 50% D-86 Distillation Point is no more than 204° F.

34. An unleaded gasoline fuel as defined in claim 1 wherein the olefin content is less than 5 volume percent.

35. An unleaded gasoline fuel as defined in claim 1 wherein the olefin content is less than 2 volume percent.

36. An unleaded gasoline fuel as defined in claim 1 wherein the olefin content is less than 0.5 volume percent.

37. An unleaded gasoline fuel as defined in claim 1 wherein the 50% D-86 Distillation Point is no more than 204° F.

38. An unleaded gasoline fuel as defined in claim 1 wherein the olefin concentration is less than 6 volume percent.

39. An unleaded gasoline fuel as defined in claim 38 wherein the 50% D-86 distillation point is less than 204° F.

40. An unleaded gasoline fuel as defined in claim 39 wherein the Reid Vapor pressure is no greater than about 7.0 psi.

41. An unleaded gasoline fuel as defined in claim 1 having a 90% D-86 distillation point no greater than 315° F.

42. An unleaded gasoline fuel, suitable for combustion in a spark ignition automotive engine, having an octane value of at least 87, an olefin content less than 3.0 volume percent, a 50% D-86 distillation point less than 204° F., and a Reid Vapor Pressure no greater than 8.0 psi (0.54 atm).

43. An unleaded gasoline fuel as defined in claim 42 wherein the Reid Vapor Pressure is no greater than 7.0 psi.

44. An unleaded gasoline fuel as defined in claim 30 wherein the Reid Vapor pressure is no greater than 7.5 psi.

45. An unleaded gasoline fuel as defined in claim 42 wherein the 50% D-86 distillation point is less than 203° F.

46. An unleaded gasoline fuel as defined in claim 45 wherein the Reid Vapor pressure is no greater than 7.5 psi.

47. An unleaded gasoline fuel as defined in claim 45 wherein the Reid Vapor pressure is no greater than 7.0 psi.

48. An unleaded gasoline fuel as defined in claim 45 wherein the 50% D-86 distillation point is no greater than 200° F.

49. An unleaded gasoline fuel, suitable for combustion in a spark ignition automotive engine, having an octane value of at least 87, a Reid Vapor Pressure no greater than 8.0 psi, containing above 77 volume percent paraffins, and having an olefin content less than 10 volume percent.

50. An unleaded gasoline fuel as defined in claim 49 wherein the olefin content is less than 8 volume percent.

51. An unleaded gasoline fuel as defined in claim 50 having a Reid Vapor pressure no greater than 7.5 psi.

52. An unleaded gasoline fuel as defined in claim 49 wherein the Reid Vapor Pressure is no greater than 7.0 psi.

53. An unleaded gasoline fuel as defined in claim 52 having a paraffin content greater than 85 volume percent.

54. An unleaded gasoline fuel as defined in claim 53 having an octane value of at least 92.

55. An unleaded gasoline fuel as defined in claim 52 having a paraffin content greater than 80 volume percent.

56. An unleaded gasoline fuel as defined in claim 55 having an octane value of at least 92.

57. An unleaded gasoline fuel as defined in claim 52 having an octane value of at least 92.

58. An unleaded gasoline fuel as defined in claim 52 having an olefin content less than 6 volume percent.

59. An unleaded gasoline fuel, suitable for combustion in a spark ignition automotive engine, having an octane value of at least 87, a Reid Vapor Pressure no greater than 7.5 psi, less than 15 volume percent olefins, and a 50% D-86 distillation point no greater than 205° F.

60. An unleaded gasoline fuel as defined in claim 59 containing less than 10 volume percent olefins.

61. An unleaded gasoline fuel as defined in claim 60 wherein the Reid Vapor Pressure is no greater than 7.0 psi.

62. An unleaded gasoline fuel as defined in claim 61 having a 50% D-86 distillation point no greater than 200° F.

63. An unleaded gasoline fuel, suitable for combustion in an automotive engine, having a Reid Vapor Pressure no greater than 7.5 psi (0.51 atm), less than 6 volume percent olefins, and a 50% D-86 distillation point no greater than 210° F.

64. An unleaded gasoline fuel as defined in claim 63 wherein the Reid Vapor Pressure in no greater than 7.0 psi.

65. An unleaded gasoline fuel suitable for combustion in a spark ignition automotive engine, said fuel having an octane value of at least 92, a Reid Vapor pressure less than 7.8 psi, and a 50% D-86 distillation point less than 211° F.

66. An unleaded gasoline fuel as defined in claim 65 wherein the Reid Vapor pressure is no greater than 7.5 psi.

67. An unleaded gasoline fuel as defined in claim 66 wherein the 50% D-86 distillation point is no greater than 205° F.

68. An unleaded gasoline fuel as defined in claim 67 wherein the 50% D-86 distillation point is no greater than 210° F.

69. An unleaded gasoline fuel as defined in claim 68 wherein the Reid Vapor Pressure is no greater than 7.0 psi.

70. An unleaded gasoline fuel as defined in claim 69 having an olefin content less than 10 volume percent.

71. An unleaded gasoline fuel as defined in claim 70 having a 50% D-86 distillation point no greater than 205° F.

72. An unleaded gasoline fuel as defined in claim 70 having a 50% D-86 distillation point no greater than 200° F.

73. An unleaded gasoline fuel as defined in claim 72 having an olefin content less than 6 volume percent.

74. An unleaded gasoline fuel as defined in claim 73 having a 90% D-86 distillation point no greater than 300° F.

75. An unleaded gasoline fuel as defined in claim 72 having an olefin content less than 4 volume percent.

76. An unleaded gasoline fuel as defined in claim 70 having a 90% D-86 distillation point no greater than 315° F.

77. An unleaded gasoline fuel as defined in claim 70 having a 90% D-86 distillation point no greater than 300° F.

78. An unleaded gasoline fuel as defined in claim 69 having an olefin content less than 6 volume percent.

79. An unleaded gasoline fuel as defined in claim 69 having an olefin content less than 4 volume percent.

80. An unleaded gasoline fuel as defined in claim 69 having a 50% D-86 distillation point no greater than 200° F.

81. An unleaded gasoline fuel as defined in claim 80 having a 90% D-86 distillation point no greater than 300° F.

82. An unleaded gasoline fuel as defined in claim 69 having a 90% D-86 distillation point no greater than 315° F.

83. An unleaded gasoline fuel as defined in claim 68 wherein the 50% D-86 distillation point is no greater than 200° F.

84. An unleaded gasoline fuel as defined in claim 65 having an olefin content less than 15 volume percent.

85. An unleaded gasoline fuel as defined in claim 65 having an olefin content less than 10 volume percent.

86. An unleaded gasoline fuel as defined in claim 85 having a Reid Vapor pressure no greater than 7.5 psi and a 50% D-86 distillation point no greater than 210° F.

87. An unleaded gasoline fuel suitable for combustion in a spark ignition automotive engine, said fuel having an octane value of at least 87, a Reid Vapor pressure no greater than 7.5 psi, and a 50% D-86 distillation point less than 204° F.

88. An unleaded gasoline fuel suitable for combustion in an automotive engine, said fuel having a Reid Vapor pressure less than 7.0 psi, and a 50% D-86 distillation point no greater than 210° F.

89. An unleaded gasoline fuel as defined in claim 88 having an olefin content less than 15 volume percent.

90. An unleaded gasoline fuel as defined in claim 88 having an olefin content less than 10 volume percent.

91. An unleaded gasoline fuel as defined in claim 88 having an olefin content less than 4 volume percent.

92. An unleaded gasoline fuel suitable for combustion in a spark ignition automotive engine, said fuel having an octane value of at least 87, a Reid Vapor pressure no greater than 7.8 psi, a 50% D-86 distillation point no greater than 215° F., and an olefin content no greater than 1.5 volume percent.

93. An unleaded gasoline fuel as defined in claim 92 wherein the Reid Vapor pressure is no greater than 7.5 psi.

94. An unleaded gasoline fuel as defined in claim 93 wherein the 50% D-86 distillation point is no greater than 210° F.

95. An unleaded gasoline fuel as defined in claim 93 wherein the 50% D-86 distillation point is no greater than 205° F.

96. An unleaded gasoline fuel as defined in claim 92 wherein the 50% D-86 distillation point is no greater than 210° F.

97. An unleaded gasoline fuel as defined in claim 92 wherein the 50% D-86 distillation point is no greater than 205° F.

98. An unleaded gasoline fuel as defined in claim 92 having a Reid Vapor pressure less than 7.8 psi and a 50% D-86 distillation point less than 215° F.

99. An unleaded gasoline fuel as defined in claim 98 having a 50% D-86 distillation point no greater than 212° F.

100. An unleaded gasoline fuel suitable for combustion in an automotive engine, said fuel having a Reid Vapor pressure no greater than 7.5 psi, a 50% D-86 distillation point no greater than 215° F., and an olefin content less than 4.0 volume percent.

101. An unleaded gasoline fuel as defined in claim 100 wherein the 50% D-86 distillation point is no greater than 210° F.

102. An unleaded gasoline fuel as defined in claim 100 wherein the 50% D-86 distillation point is no greater than 205° F.

103. An unleaded gasoline fuel suitable for combustion in a spark ignition automotive engine, said fuel having an octane value of at least 87, a Reid Vapor pressure no greater than 8.0 psi, a 50% D-86 distillation point less than 205° F., and an olefin content less than 5.0 volume percent.

104. An unleaded gasoline fuel as defined in claim 103 wherein the Reid Vapor pressure is no greater than 7.5 psi.

105. An unleaded gasoline fuel as defined in claim 103 wherein the Reid Vapor pressure is no greater than 7.0 psi.

106. An unleaded gasoline fuel suitable for combustion in a spark ignition automotive engine, said fuel having an octane value of at least 87, a Reid Vapor pressure no greater than 7.5 psi, and a 50% D-86 distillation point no greater than 205° F., and an olefin content less than 15.0 volume percent.

107. An unleaded gasoline fuel suitable for combustion in an automotive engine, said fuel having a Reid Vapor pressure no greater than 7.5 psi, and a 50% D-86 distillation point no greater than 210° F., and a paraffin content greater than 65 volume percent.

108. An unleaded gasoline fuel as defined in claim 107 wherein the paraffin content is greater than 72 volume percent.

109. An unleaded gasoline fuel as defined in claim 107 wherein the olefin content is less than 10 volume percent.

110. An unleaded gasoline fuel as defined in claim 109 having a Reid Vapor pressure no greater than 7.0 psi.

111. An unleaded gasoline fuel as defined in claim 110 having a 50% D-86 distillation point no greater than 200° F.

112. An unleaded gasoline fuel as defined in claim 110 having a paraffin content greater than 75 volume percent.

113. An unleaded gasoline fuel as defined in claim 112 having an olefin content less than 4 volume percent.

114. An unleaded gasoline fuel as defined in claim 113 having a paraffin content greater than 85 volume percent.

115. An unleaded gasoline fuel as defined in claim 113 having a 50% D-86 distillation point no greater than 200° F.

116. An unleaded gasoline fuel as defined in claim 115 having a 90% D-86 distillation point no greater than 300° F. and a paraffin content greater than 85 volume percent.

117. An unleaded gasoline fuel as defined in claims 1, 32, 38, 43, 52, 60, 65, 61, 115, 118, 45, 48, 99, 104, 109, 112, 44, 13, 93, 94, 72, 80, 75, 53, 113, 115, or 78 wherein the maximum 10% distillation point is 158° F. (70° C.).

118. An unleaded gasoline fuel as defined in claim 110 having a 90% D-86 distillation point no greater than 315° F.

119. An unleaded gasoline fuel as defined in claim 110 having a 90% D-86 distillation point no greater than 300° F.

120. An unleaded gasoline fuel as defined in claim 1, 2, 49, 64, 90, 91, 103, 112, 125, 127, 93, 94, 72, 80, 82 or 55 wherein the Reid Vapor Pressure is no greater than 6.8 psi. and the maximum 10% distillation point is 158° F. (70° C.).

121. An unleaded gasoline fuel as defined in claim 120 wherein the Reid Vapor Pressure is no greater than 6.5 psi.

122. An unleaded gasoline fuel as defined in claim 107 wherein the olefin content is less than 6 volume percent.

123. An unleaded gasoline fuel as defined in claim 122 wherein the 50% D-86 distillation point is no greater than 205° F.

124. An unleaded gasoline fuel as defined in claim 122 wherein the 50% D-86 distillation point is no greater than 205° F. and the paraffin content is greater than 75 volume percent.

125. An unleaded gasoline fuel as defined in claim 124 wherein the Reid Vapor pressure is no greater than 7.0 psi.

126. An unleaded gasoline fuel as defined in claim 125 having a 50% D-86 distillation point no greater than 200° F.

127. An unleaded gasoline fuel as defined in claim 126 having a 90% D-86 distillation point no greater than 315° F.

128. An unleaded gasoline fuel as defined in claim 122 wherein the Reid Vapor pressure is no greater than 7.0 psi.

129. An unleaded gasoline fuel as defined in claim 107 wherein the Reid Vapor pressure is no greater than 7.0 psi.

130. An unleaded gasoline fuel as defined in claim 129 having a paraffin content greater than 70 volume percent.

131. An unleaded gasoline fuel as defined in claim 129 having a paraffin content greater than 72 volume percent.

132. An unleaded gasoline fuel as defined in claim 129 having a 50% D-86 distillation point no greater than 205° F. and a paraffin content greater than 75 volume percent.

133. An unleaded gasoline fuel as defined in claim 132 having a paraffin content greater than 85 volume percent.

134. An unleaded gasoline fuel as defined in claim 133 having a 50% D-86 distillation point no greater than 200° F.

135. An unleaded gasoline fuel as defined in claim 129 having a paraffin content greater than 85 volume percent.

136. An unleaded gasoline fuel as defined in claim 129 having a 50% D-86 distillation point no greater than 200° F.

137. An unleaded gasoline fuel as defined in claim 136 having a paraffin content greater than 75 volume percent.

138. An unleaded gasoline fuel as defined in claim 129 having a 50% D-86 distillation point no greater than 205° F.

139. An unleaded gasoline fuel as defined in claim 129 having a 90% D-86 distillation point no greater than 315° F.

140. An unleaded gasoline fuel as defined in claim 107 having a 50% D-86 distillation point no greater than 200° F.

141. An unleaded gasoline fuel as defined in claim 140 having a paraffin content greater than 70 volume percent.

142. An unleaded gasoline fuel, suitable for combustion in a spark ignition automotive engine, having an olefin content less than 3.0 volume percent, a 50% D-86 distillation point no greater than 205° F. (96° C.), the Reid Vapor Pressure is no greater than 8.0 psi (0.54 atm), and an octane value of at least 92.

143. An unleaded gasoline fuel suitable for combustion in an automotive engine, said fuel having a Reid Vapor pressure no greater than 7.0 psi, and a 50% D-86 distillation point no greater than 215° F., and an olefin content less than 8 volume percent.

144. An unleaded gasoline fuel as defined in claim 143 having an olefin content less than 6 volume percent.

145. An unleaded gasoline fuel as defined in claim 144 having a 50% D-86 distillation point no greater than 200° F.

146. An unleaded gasoline fuel as defined in claim 144 having a 90% D-86 distillation point no greater than 315° F.

147. An unleaded gasoline fuel as defined in claim 143 having an olefin content less than 4 volume percent.

148. An unleaded gasoline fuel as defined in claim 147 having a 50% D-86 distillation point no greater than 210° F.

149. An unleaded gasoline fuel as defined in claim 148 having a 50% D-86 distillation point no greater than 200° F.

150. An unleaded gasoline fuel as defined in claim 143 having a 50% D-86 distillation point no greater than 200° F.

151. An unleaded gasoline fuel, suitable for combustion in a spark ignition automotive engine, having an octane value of at least 87, a Reid Vapor Pressure no greater than 8.0 psi., a paraffin content above 77 volume percent, and a maximum 10% distillation point of 158° F. (70° C.).

152. An unleaded gasoline fuel as defined in claim 151 wherein the Reid Vapor Pressure is less than 7.0 psi.

153. An unleaded gasoline fuel as defined in claim 152 having a paraffin content above 80 volume percent.

154. An unleaded gasoline fuel as defined in claim 151 wherein the Reid Vapor Pressure is no greater than 6.8 psi.

155. An unleaded gasoline fuel as defined in claim 154 having a paraffin content above 82 volume percent.

* * * * *

UNITED STATES PATENT AND TRADEMARK OFFICE

CERTIFICATE OF CORRECTION

PATENT NO. : 5,288,393

DATED : February 22, 1994

INVENTOR(S) : Peter J. Jessup et al.

It is certified that error appears in the above-indentified patent and that said Letters Patent is hereby corrected as shown below:

In column 5, Table 1 (under the heading "Properties"), after "Dist. 90% (°F.)," change "min" to -- max --.

In column 21, line 59, after "Pressure," delete "in" and insert therefor -- is --.

In column 22, line 4, delete "67" and insert therefor -- 66 --.

In column 22, line 45, delete "68" and insert therefor -- 66 --.

In column 23, line 46, delete "205°F." and insert therefor -- 204°F --.

In column 24, lines 25 and 26, delete

"65, 61, 115, 118, 45, 48, 99, 104, 109, 112, 44, 13, 93, 94, 72, 80, 75, 53, 113, 115, or 78" and replace with -- 64, 61, 68, 69, 87, 88, 96, 101, 105, 106, 109, 128, 125, 44, 13, 90, 91, 143, 144, 70, 78, 73, 53, 110, 112, 41, 76, 118, 119, or 116 -- .

UNITED STATES PATENT AND TRADEMARK OFFICE

CERTIFICATE OF CORRECTION

PATENT NO. : 5,288,393

DATED : February 22, 1994

INVENTOR(S) : Peter J. Jessup et al

It is certified that error appears in the above-indentified patent and that said Letters Patent is hereby corrected as shown below:

In column 24, lines 35 and 36, delete "64, 90, 91, 103, 112, 125, 127, 93, 94, 72, 80, 82 or 55" and replace with -- 63, 87, 88, 100, 109, 122, 124, 90, 91, 70, 78, 79, 55, 118, or 119 --.

Signed and Sealed this

Eleventh Day of April, 1995

Bruce Lehman

*Attest:*

BRUCE LEHMAN

*Attesting Officer*

*Commissioner of Patents and Trademarks*

Disclaimer and Dedication

5,288,393—Peter J. Jessup; Michael C. Croudace, both of Santa Ana, Calif. GASOLINE FUEL. Patent dated February 22, 1994. Disclaimer filed Aug. 11, 2005, by the assignee, Union Oil Company of California.

Hereby disclaims and dedicates to the public the term of this patent, subsequent to August 10, 2005.

*(Official Gazette, October 18, 2005)*

US005288393C1

(12) EX PARTE REEXAMINATION CERTIFICATE (5770th)

United States Patent

Jessup et al.

(10) Number: US 5,288,393 C1

(45) **Certificate Issued: *May 29, 2007**

(54) GASOLINE FUEL

(75) Inventors: Peter J. Jessup, Santa Ana, CA (US); Michael C. Croudace, Santa Ana, CA (US)

(73) Assignee: Union Oil Company of California, Los Angeles, CA (US)

Reexamination Request:
No. 90/005,942, Mar. 1, 2001
No. 90/006,295, May 20, 2002
No. 90/006,683, Jun. 25, 2003

Reexamination Certificate for:

| | |
|---|---|
| Patent No.: | **5,288,393** |
| Issued: | **Feb. 22, 1994** |
| Appl. No.: | **07/628,488** |
| Filed: | **Dec. 13, 1990** |

( * ) Notice: This patent is subject to a terminal disclaimer.

(51) Int. Cl.
*C10L 1/04* (2006.01)

(52) U.S. Cl. ..... 208/16; 208/14; 208/15; 208/18; 585/14

(58) Field of Classification Search ..... None
See application file for complete search history.

(56) References Cited

U.S. PATENT DOCUMENTS 2,818,417 A * 12/1957 Brown et al.
5,113,803 A * 5/1992 Hollrah et al.
5,599,357 A * 2/1997 Leeper
5,679,116 A * 10/1997 Cunningham et al.
5,782,937 A * 7/1998 Colucci et al.

OTHER PUBLICATIONS

Zaghini et al., Polynuclear Aromatic Hydrocarbons in Vehicle Exhaust Gas, SAE 730836, Sep. 1973.*

CRC Report No. 461, Analysis of 1971 Road Rating Data: Unleaded Gasolines in 1971 Cars Phase II: 1970–71 CRC Read Rating Program, Jun. 1973.*

Date et al., Road Octane Number Trends of Japanese Passenger Cars, SAE 770811, Sep. 1977.*

1984 Annual Book of ASTM Standards, Section 5, Petroleum Products, Lubricants, and Fossil Fuels, pp. 8–27, 176–184 and 690–697.*

*Talbert Fuel Systems Patents Co.,* v. *Unocal Corporation, Union Oil Company of California and Tosco Corporation*, CAFC 99–1421, Jan. 8, 2002.*

Declaration of William L. Talbert, Case No. 98–0412 KMW (RNBx), dated Mar. 29, 1998, pp. 78–80.*

Declaration of David S. Hirshfeld, Case. No. 98–0412 KMW (RNBx), dated Mar. 29, 1998, pp. 65–77.*

Trial Exhibit 2900 in *Union Oil Co. of Calif.* vs. *ARCO et al.* C.D. Ca, Case No. CV–95–2379 KMW (JRx), date unknown.*

Memorandum of Decision Granting in Part and Denying in Part Plaintiffs' Motion for Summary Judgment for Construction of the '393 Patent as a Matter of Law and for Lack of Novelty, C.D. Ca, Case No. CV–95–2379 KMW (JRx), May 22, 1997.*

Memorandum of Decision and Order Denying (1) Plaintiffs' Motion for Summary Judgment Re: Implied License, Estoppel, and Unclean Hands and (2) Defendants; Motion for Summary Judgement: Re: Equitable Estoppel, C.D. Ca, No. CV–95–2379 KMW (JRx), May 22, 1987.*

Order Denying Plaintiffs' Motion for Summary Judgment of Patent Claim Invalidity Under 35 U.S.C. § 112 on Grounds of Indefiniteness and Nonenablement, C.D. Ca, Case No. CV–95–2379 KMW (JRx), dated Mar. 3, 1997.*

Order Denying Plantiffs' Motion for Summary Judgment That Unocal's '393 Patent is Unenforceable Because of Inequitable Conduct, C.D. Ca, Case No. CV–95–2379 KMW (JRx), dated Mar. 3, 1997.*

Plaintiffs' Trial Exhibit List: Patents in 282 Notice, C.D. Ca, Case No. CV–95–2379 KMW (JRx), pp. 1–16, Jun. 3, 1997.*

Plaintiffs' Trial Exhibit List: Publications in 282 Notice, C.D. Ca, Case No. CV–95–2379 KMW (JRx), pp. 1–91, Jun. 3, 1997.*

Appendix A (Attachment to Plaintiffs' Memorandum of Contentions of Fact and Law Pursuant to Local Rule 9.5, C.D. Ca, Case No. CV–95–2379 KMW (JRx), executed Jun. 11, 1997.*

Notice of Filing of Supplemental Appendix A to Plaintiffs' Memorandum of Contentions of Fact and Law, C.D. Ca, Case No. CV–95–2379 KMW (JRx), dated Jun. 24, 1997.*

Notice of Filing of Second Supplemental Appendix A to Plaintiffs' Memorandum of Contentions of Fact and Law, C.D. Ca, Case No. CV–95–2379 KMW (JRx), dated Jun. 30, 1997.*

Court's Jury Instructions, C.A. Ca, Case No. CV–95–2379–KMW, dated Sep. 24, 1997.*

Special Verdict Form, C.A. Ca, Case No. CV–95–2379–KMW, Oct. 14, 1997.*

Court's Jury Instructions—Phase II (Damages), C.A. Ca, Case No. CV–95–2379–KMW, dated Oct. 24, 1997.*

Special Verdict Form—Phase II (Damages), C.A. Ca, Case No. CV–95–2379–KMW, dated Oct. 10, 1997.*

Order Denying Defendants' Motion for Judgment as a Matter of Law, C.A. Ca, Case No. CV–95–2379–KMW, dated Mar. 6, 1998.*

Judgment, C.A. Ca, Case No. CV–95–2379–KMW, dated Aug. 31, 1998.*

Phase III: Memorandum of Decision Setting Forth the Court's Factual Findings and Conclusions of Law, C.A. Ca, Case No. CV–95–2379–KMW(JRx), dated Aug. 31, 1998.*

(Continued)

*Primary Examiner*—Jerry D. Johnson

(57) ABSTRACT

By controlling one or more properties of a gasoline fuel suitable for combustion in automobiles, the emissions of $NO_x$, CO and/or hydrocarbons can be reduced. The preferred fuel for reducing all three such emissions has a Reid Vapor Pressure no greater than 7.5 psi (0.51 atm), essentially zero olefins, and a 50% D-86 Distillation Point greater than about 180° F. (82° C.) but less than 205° F. (96.1° C.).

OTHER PUBLICATIONS

Order Re: Attorneys' Fees, C.A. Ca, Case No. CV–95–2379–KMW, dated Sep. 10, 1998.*

Order Granting Plaintiff's Rule 59c Motion; Granting and Staying Request For Accounting and Denying Plaintiff's ex parte Application for Magistrate Judge Designation, C.A. Ca, Case No. CV–95–2379–KMW(JRx), dated Sep. 28, 1998.*

Judgment Pursuant to 28 USC § 1292c(2), C.A. Ca, Case No. CV–95–2379–KMW(JRx), dated Sep. 28, 1998.*

Decision CAFC: 99–1066 *Union Oil Company of Cal.* v. *Atlantic Richfield Co., Chevron U.S.A. Inc., Exxon Corp., Mobil Oil Corp., Shell Oil Products Co., Texaco Refining and Marketing, Inc.,* Mar. 29, 2000.*

Order of United States Court of Appeals for the Federal Circuit, 99–1066, dated May 18, 2000.*

Order of Supreme Court of United States, dated Feb. 20, 2001.*

Notice of Motion and Motion to Stay Proceedings Pending Reexamination of U.S. Patent No. 5,288,393, dated Jun. 21, 2001.*

Amended Notice of Appeal, C.D. Ca, Case No. 98–0412 CBM (RNBx), dated Nov. 12, 1999.*

Request for Investigation of unocal Corporation's Expansion of its RFG Patent Rights, letter by Donald B. Craven to Molly S. Boast of the FTC, dated Mar. 14, 2001.*

Memorandum of Exxon Mobil Corp. in Support of Request that the FTC Investigate the unfair Competition Issues Raised by Unocal Corporation's Patenting of Reformulated Gasoline Standards, accompanying letter dated Mar. 14, 2001.*

Letter from David F. Conn of the FTC to Dennis P.R. Condon of Unocal dated Aug. 10, 2001.*

Cover letter from Charles O. Strathman of unocal to Richard B. Dagen, Geoffrey Oliver, and David F. Conn of the FTC, dated Aug. 17, 2001.*

Position Paper of Union Oil Company of California accompany cover letter of Aug. 17, 2001.*

Supporting documents for position paper accompanying cover letter of Aug. 17, 2001.*

Affidavit of Robert E. Cunningham accompanied by a letter dated Sep. 26, 2001 from Joan E. Fina of the FTC to Martin R. Lueck.*

Cover letter form Charles O. Strathman of Unocal to Richard B. Dagen, Geoffrey Oliver, and David F. Conn of the FTC, dated Oct. 10, 2001.*

Position paper of Union Oil Company of California Re: Affidavit of Robert E. Cunningham accompanying cover letter of Oct. 10, 2001.*

Letter from Michael P. Kenny of the California Air Resources Board to Joseph J Simmons of the FTC dated Jul. 12, 2001 accompanied by a letter dated Sep. 10, 2001 from Joan E. Fina of the FTC to Martin R. Lueck.*

Complaint for Patent Infringement by *Union Oil Company of California, Plaintiff,* vs. *Valero Energy Corporation,* Defendant, date unknown.*

"Regulation of Fuels and Fuel Additives: Standards for Reformulated and Conventional Gasoline," Federal Register, vol. 59, No. 32, Feb. 16, 1994, pp. 7716–7878.

Emissions Results of '393 Invention Claim by Claim per EPA Complex Model Described in Federal Register vol. 59, No. 32, Feb. 16, 1994.

"Jul. 1, 1997 Motions in Limine and Other Motions," U.S. Disctrict Court, Central District of California, Case No. CV–95–2379–KMW.

*Union Oil Co. of California* v. *Chevron U.S.A., Inc.,* 34 F.Supp.2d 1222 (C.D. Cal. 1998).

*Union Oil Co. of California* v. *Atlantic Richfield Co.,* 34 F.Supp.2d 1208 (C.D. Cal 1998).

Outline of Daily Trial Transcripts, *ARCO, et al.* v. *UNOCAL,* U.S. District Court, Central District of California, Case No. CV–95–2379–KMW, date unknown.

Memorandum "Reformulated Gasoline Meeting—July 28," by M.C. Ingham (Trial Exhibit 321, U.S. District Court (C.D. Ca.) CA No. CV–95–2379 KMW (JRx)).

"Evaluation of the Effects of Lowering Gasoline Volatility from 7.8 to 7.0 RVP: A Work Plan," California Air Resources Board, Oct. 1990 (Trial Exhibit 1372, U.S. District Court (C.D. Ca.) CA No. CV–95–2379 KMW (JRx)).

API Memorandum from David Lax to Gasoline Vehicle Emissions Task Force, Mar. 30, 1990 Bates pp. U0049376–U0049402.

CVS News, A Report on the California Vehicle Pollution Program, Sep. 1990, pp. 1–48, (Trial Exhibit 1375, U.S. District Court (C.D. Ca.) CA No. CV–95–2379 KMW (JRx)).

"Volatility Regulation for Gasoline and Alcohol Blends Sold in Calendar Years 1992 and Beyond," Federal Register, vol. 55, No. 112, Jun. 11, 1990, pp. 23658–23667.

J. Feller, "Design Experiments that Control Two or More Variables at Once," *Industrial Research and Development*, Jul. 1983, pp. 94–95.

Magill, P. L., "Techniques Employed in the Analysis of Los Angeles Smog," Proceedings of the First National Air Pollution Symposium, Nov. 10–11, 1949, p. 61.

"The Smog Problem in Los Angeles County," A Report by Stanford Research Institute on Studies to Determine the Nature and Causes of Smog, Jan. 1954, p. 5.

Faith, W.L., "Air Pollution Control", Air Pollution Foundation, San Marino, California, 1959, p. 5.

"Effects of Air Pollution on Humans," Air Pollution, Edited by A. C. Stern, U.S. Public Health Service, vol. I, 1962, p. 365.

Air Pollution, Edited by A. C. Stern, U.S. Public Health Service, vol. II, 1962, pp. 40 and 403–405.

Waldbott, George L., M.D. "Health Effects of Environmental Pollutants," The C. V. Mosby Company, St. Louis, 1973, pp. 4 and 5.

Stern et al., "Fundamentals of Air Pollution," Academic Press, New York and London, 1973, pp. 59–61.

"Rethinking the Ozone Problem in Urban and Regional Air Pollution," Committee on Tropospheric Ozone Formation and Measurement, National Research Council, National Academy Press, Washington, D.C., 1991, pp. i–iii, 2–5, 32–35, 67–75.

"Historical Smog Chart," Air Quality Management District, http://www.aqmd.gov/smog/histsmog.html, (last updated Mar. 10, 1999 dated Jul. 25, 2001.

"Regulation of Fuels and Fuel Additives: Volatility Regulations for Gasoline and Alcohol Blends Sold in 1989 and Later Calendar Years and Control of Air Pollution from New Motor Vehicles and New Motor Vehicle Engines: Evaporate Emissions Regulations for 1990 and Later Model Year Gasoline–Fueled Light–Duty Vehicles, Light–Duty Trucks, and Heavy Duty Vehicles," Federal Register, vol. 52, No. 160, Aug. 19, 1987 (Proposed Rules), pp. 31274–31363.

Trial Exhibit 3525, U.S. District Court, Central District of California, Case No. CV–95–2379 KMW ($Jr_x$), date unknown.

"Exxon Says Unocal Gained Monopoly With Gas Patents," Reuters, May 8, 2001.

Statement of Robert Perciasepe, Assistant Administrator, Office of Air & Radiation, U.S. Environmental Protection Agency Before The Committee on The Judiciary U.S. House of Representatives, Jun. 28, 2000, pp. 1–5.

"Unocal Says RFG Patent 'Not a Factor' in Midwest Gas Prices," FPMA News, Jun, 22, 2000.

"US Refiners Eye Appealing Unocal Case to Supreme Court," Dow Jones Energy Service, May 23, 2000.

*Union Oil Company of California* v. *Atlantic Richfield Company et al.,* U.S. District Court, Central District of California, "Stipulation to Continue to Jul. 16, 2001 The Hearing on Defendants' Motion to Vacate Accounting Order, to Reopen The Record for Additional Evidence, and To Limit Accounting Order To California Gasolines if No New Evidence is Allowed; Order Thereon," filed Jun. 6, 2001, Case No. CV95 2379–JSL (JRx).

"Gasoline Marketing Uncertainties Surround Reformulated Gasoline as a Motor Fuel," Report to the Chairman, Subcommittee on Energy and Power, Committee on Energy and Commerce, House of Representatives, Jun. 1990, Trial Exhibit 383, pp. 1–22.

Calvert, J.G. et al., "Achieving Acceptable Air Quality: Some Reflections on Controlling Vehicle Emissions," *Science*, vol. 261, Jul. 2, 1993, Trial Exhibit 795, pp. 37–44.

"Ruling on California Fuels to Have Ripple Effect," *Oil Daily*, vol. 51, No. 112, Jun. 12, 2001, pp. 1–2.

"State Sues EPA Over Gasoline Additives," latimes.com, Aug. 13, 2001, pp. 1–2.

Ex Parte Hyatt, Appeal No. 98–1913, 1999 WL 33206107 at *1 (PTO Bd. Pat. App. & Inter. Feb. 8, 1989).

Trial Transcript and Evidentiary Exhibit from *Arco et al.* v. *Unocal* (i.e., *Atlantic Richfield et al* v. *Unocal Corporation et al.,* United States District Court, Central District of California, No. CV 95–2379–KMW), involving U.S. Patent 5,288,393.

"Affidavit Under 37 CFR 1.132," by Dr. Jessup Filed Apr. 15, 2002 in Reexamination Control, No. 90/005,942, U.S. Patent 5,288,393.

"2$^{nd}$ Affidavit Under 37 CFR 1.132," by Dr. Jessup Filed Mar. 13, 2003 in Merged Reexaminations COntrol Nos. 90/005,942 and 90/006,295, U.S. Patent 5,288,393.

CRC Report No. 477, "1973 CRC Fuel Rating Program Part I: Road Octane Performance in 1973 Model Cars," Feb. 1975, pp. 1–194.

"Comments on the Gasoline Additive MMT (methycyclopentadienyl manganese tricarbonyl)," Downloaded from EPA website on Feb. 5, 2002, One Sheet.

"Section 2254, Manganese Additive Content," California Title 13 Motor Vehicles, California Air Resources Board, Jun. 16, 2000, p. 3.

"The California Reformulated Gasoline Regulations," Title 13, California Code of Regulations, Sections 2250–2272. California Air Resources Board, Jan. 26, 1996, pp. 28–30.

ASTM Designation: D 323–58, "Standard Method of Test for Vapor Pressure of Petroleum Products (Reid Method)," Adopted 1958, with editorial changes through 1960, pp. 143–151.

ASTM Designation: D 5580–95, "Standard Test Method for Determination of Benzene, Toluene, Ethylbenzene, p/m Xylene, o–Xylene, $C_g$ and Heavier Aromatics, and Total Aromatics in Finished Gasoline by Gas Chromatography," Nov. 1995, pp. 784–792.

ASTM Designation: D 86–90, "Standard Test Method for Distillation of Petroleum Products," Nov. 1990, pp. 7–17.

ASTM Designation: D 1319–93, "Standard Test Method for Hydrocarbon Types in Liquid Petroleum Products by Fluorescent Indicator Adsorption," Jun. 1993, pp. 458–462.

ASTM Designation: D 323–90, "Standard Test Method for Vapor Pressure of Petroleum Products (Reid Method)," Dec. 1990, pp. 130–134.

"§2263. Sampling Procedures and Test Methods," California Title 13 Motor Vehicles, Downloaded from California Code of Regulations website http://ccr.oal.ca.gov/ on Mar. 18, 2002, 3 pages.

"Manual on Determining Precision Data for ASTM Methods on Petroleum Products and Lubricants," (RR D–2–1007), Dec. 1972, with editorial changes in Aug. of 1990, pp. 1072–1106.

"ASTM Standards on Precision and Bias For Various Applications," Fifth Edition, 1997, pp. i–iii, v–vi, 82–89, 138–149, 191–194, 234–237, 258–269, and 413–447.

Owen, Keith and Coley, Trevor, "Automotive Fuels Reference Book," Second Edition, Society of Automotive Engineers, Inc., Warrendale, PA, 1995, p. 884.

Final Regulatory Impact Analysis and Summary and Analysis of Comments, Phase II Gasoline Volatility Regulations, May 1990, U.S. Environmental Protection Agency, Office of Air and Radiation, Office of Mobile Sources, May 1990, Chapters 1–6, pp. 1–1 to 6–4.

Carter, J.S., ExxonMobil Fuels Marketing Company, Statement before the Senate Permanent Subcommittee on Investigations, Apr. 30, 2002, pp. 1–6.

"Gas Additive Challenged," Washington Post, Monday, Aug. 5, 2002, pp. 1–3.

"Agreement (Reid Vapor Pressure and Driveability Index Testing Program)" among California Air Resources Board ("CARB"), General Motors, oil companies (e.g., ARCO et al.), and Western States Petroleum Association ("WSPA") agreeing to engage in cooperative research, May 1, 1991, pp. 1–15 with Exhibits 1–3.

"GM's Gasoline Specs Upset the Refiners," *Business Week*, Jan. 22, 1972, p. 20.

CRC Report No. 503, "CRC MMT Field Test Program," Executive Summary (vol. I), Jun. 1979, pp. 1–4 and Data Analysis (vol. III) Jun. 1979, pp. 1–49 and 52–90.

"Measurement," Columbia Encylopedia, Sixth Edition, 2001, downloaded from Bartleby.com, pp. 1–2.

"Motor Gasoline, Sample ID: MG0208," Committee D–2, Interlaboratory Crosscheck Program, ASTM International, Aug. 2002, pp. 1–135 plus Appendix pp. 2–5.

Shih, Celia, "Fuel Volatility Effects on Exhaust Emmisions," Technical Report No. EPA–AA–TEB–EF–90–4, U.S. Environmental Protection Agency, Aug. 1990, pp. 1–41.

"Emissions Results of Oxygenated Gasolines and Changes in RVP," Technical Bulletin No. 6, Auto/Oil Air Quality Improvement Research Program, Sep. 1991, pp. 1–12.

Stone, R.K., and Eccleston, B.H., "Vehicle Emissions vs. Fuel Composition—API–Bureau of Mines—Part II," API Preprint 41–69–Division of Refining, Chicago, May 13, 1969, pp. 651–690.

"Canadian Refiners Facing Possible Two–Year–Plus Wait to Resume MMT Use," *World Refining*, Mar. 2005, p. 12.
Compact Disc containing transcripts of FTC trial in the Mater of Union Oil Company of California (two copies submitted).
Certificate of Correction dated Apr. 11, 1995.
Disclaimer dated Dec. 29, 1994.
Disclaimer dated Jul. 5, 1995.
Chart: The 41 Undisclaimed Claims of the '393 Patent.
"GM Bids for Radically New Gasoline," *Oil & Gas J.,* Jan 17, 1972, pp. 53–54.
"GM still wants costly light gasoline" *Oil & Gas J.,* Oct. 2, 1972, pp. 44 and 46.
Adams, Frank H. "New Technology Complements An Aliphatic Route to Future Gasolines." American Petroleum Institute, May 14–17, 1973, pp. 104–122.
Chart: '393 Patent Claims Compared to the GM–1 Specifications.
Chart: '393 Patent Claims Compared to the GM–2 Specifications.
"Standard Specification for Automotive Spark–Ignition Engine Fuel," ASTM D4814–89, pp. 598–625.
Ser. No. 628,488, pp. 337–352 (Dec. 16, 1992 Amendment).
Ser. No. 628,488, pp. 90–98 (IDS No. 2).
"Regulations of Fuels and Fuel Additives," *Federal Register*, vol. 38, No. 6, Jan. 10, 1973, pp. 1254–1256.
Piel, William J., "Ethers will play key role in 'clean' gasoline blends." *Oil & Gas J.,* Dec. 4, 1989, pp. 40–44.
Wagner, T.O., "Motor Gasoline and Automotive Air Pollution," SAE Technical Paper Series 710485, Jun. 1971, pp. 55–62.
"Volatility Controls Face Opposition," *Chemical Week*, Apr. 22, 1987, pp. 10–11.
"EPA proposes to stiffen controls on Gasoline," *Oil & Gas J.,* Jul. 27, 1987, pp. 23–24.
EPA Notice Of Proposed Rulemaking: "Regulation of Fuels and Fuel Additives: Volatility Regulations for Gasoline and Alcohol Blends Sold in 1989 and Later Calendar Years and Control of Air Pollution From New Motor Vehicles and New Motor Vehicle Engines: Evaporative Emissions Regulations for 1990 and Later Model Year Gasoline–Fueled Light–Duty Vehicles, Light–Duty Truck and Heavy–Duty Vehicles," *Federal Register*, vol. 52, No. 190, Aug. 19, 1987.
Emissions predicted by EPA Complex Model for '393 patent claims (full scope).
Emissions Summary Chart for '393 patent claims (full scope).
Emissions predicted by EPA Complex Model for '393 patent claims (90th percentile).
Emissions Summary Chart for '393 patent claims (90th percentile).
*Union Oil Co. of California* v. *Atlantic Richfield Co.,* 208 F. 3d 989 (Fed. Cir. 2000).
*Union Oil Co. of California* v. *Atlantic Richfield Co.* (liability jury verdict).
"Changes keep HF alkylation up–to–date," *Oil & Gas J.,* Feb. 11, 1974, pp. 78–82.
"GM's Gasoline Specs Upset The Refiners," *Business Week*, Jan. 22, 1972, p. 20.
Piel, William and Thomas, R.X. "Ethers: A Key Ingredient for Reformulated Gasoline," *National Conference on Octane Quality & Reformulated Fuels*, San Antonio, TX, Mar. 27–29, 1990.
EPA "Draft Regulatory Impact Analysis: Control of Gasoline Volatility and Evaporative Hydrocarbon Emissions From New Motor Vehicles" (Jul. 1987), pp. 1–1 to 1–4, 2–13 to 2–16, 2–109 to 2–112, 2–115 to 2–118, 2–161 to 2–164, 2–167 to 2–169, 3–1 to 3–10, 3–13, 3–14, 3–21, 3–22, 3–24, to 3–27, 3–45, 3–46, 3–66.
EPA "Final Regulatory Impact Analysis [For Phase I] and Summary and Analysis of Comments on the NPRM—Imterim Control of Gasoline Volatility" (Jan. 1989).
EPA Final Rule for Phase I: "Volatility Regulation for Gasoline and Alcohol Blends Sold in Calendar Years 1989 and Beyond" (Mar. 1989), pp. 11867–11869, 11880.
EPA "Final Regulatory Impact Analysis and Summary and Analysis of Comments: Phase II Gasoline Volatility Regulations" (May 1990).
Exhaust Emissions Calculated Using '393 Patent Equations Comparing CRC 494 Fuel 6.
Exhaust Emissions Calcullated Using '393 Patent Equations Comparing Prior Art SAE 770811 Fuel F–1.
Octane Week (Nov. 5, 1990), pp. 1–12.
Auto/Oil Agreement (Oct. 16, 1989), pp. 1–5 and 26.
1990 Clean Air Act Amendments, pp. 109–113.
Cunningham, Robert F. [E.] and Miller, Charles L., "Costs and Impacts of California Phase 2 Gasoline Regulations," Presented at the 1992 NPRA Annual Meeting Mar. 22–24, 1992.
Lyons Expert Report, pp. 1–2.
Unocal motion *in limine* to exclude Lyons Experts Report, Memorandum pp. 6–9.
Opposition to Unocal's motion *in limine*, Memorandum p. 1.
Order excluding Lyons testimony.
Reexamination Control No. 90/005,942, Interview Infomation Item AAB.
Reexamination Control No. 90/005,942, Apr. 11, 2002 Response To Rejection, pp. 1,9,10,24–26,37,38,42–44.
ASTM D 439–70, pp. 173–183.
Reexamination Control Nos. 90/005,942 and 90/006,295, Brief On Appeal, pp. 1 7, 9–15, 20–26, 85–87, 105, 107, 109, 112, 117–119, 121–26, 128, 130–132.
Reexamination Control Nos. 90/005,942 and 90/006,295, 2nd Affidavit Under 37 CFR 1.132, pp. 1, 6–11, and 23–25.
In the Matter of Union Oil Company of California, FTC Docket No. 9305, Union Oil Company California's Motion For Dismissal Of The Complaint And Memorandum In Support For Failure To Make Sufficient Allegations That Respondent Possesses Or Dangerously Threatens To Possess Monopoly Power, pp. 1, 14, 20.
Reexamination Control Nos. 90/005,942 and 90/006,295, Appendix N of Brief On Appeal (emissions comparisons for prior art and claimed fuels).
Reexamination Control Nos. 90/005,942 and 90/006,295, Appendix O of Brief On Appeal (emissions comparisons for prior art and claimed fuels).
Reexamination Control Nos. 90/005,942 and 90/006,295, Appendix U of Brief On Appeal (rebuttal to Cunningham Declaration re EPA's knowledge that reducing RVP reduced exhaust emissions).
Relative Exhaust Emissions From '393 Patent Equations, Summary of Prior Art Fuels vs. '393 Patent Claim.
Owen, Keith and Coley, Trevor, "Automotive Fuels Reference Book," Second Edition, Society of Automotive Engineers, Inc., Warrendale, PA, 1995, pp. 119–120, 324, 152–153.

Brown, J.E. and Lovell, W.G., "A New Manganese Antinkock," Symposium on Chemistry and Technology of Petroleum Fuels of The Future, Presented Before the Division of Petroleum Chemistry, American Chemical Society, San Francisco Meeting, Apr. 13–18, 1958, pp. C–45 to C–58.
SAE 710485, Wagner, T.O., "Motor Gasoline and Automotive Air Pollution," Society of Automotive Engineers, Jun. 1971, pp. 55–62.
SAE 770655, Benson, J. D., "Manganese Fuel Additive (MMT) Can Cause Vehicle Problems," Society of Automotive Engineers, Fuels and Lubricants Meeting, Tulsa, June 7–9, 1977, pp. 1–23.
SAE 770656, Lenane, D. L., "MMT—A Further Evaluation," Society of Automotive Engineers, Fuels and Lubricants Meeting, Tulsa, Jun. 7–9, 1977, pp. 1–18.
SAE 780004, Furey, Robert L. and Summers, Jack. C., "How MMT Causes Plugging of Monolithic Converters," Society of Automotive Engineers, Congress and Exposition, Detroit, Feb. 27–Mar. 3, 1978, pp. 1–16.
Cunningham, Robert E. and Miller, Charles L., "Cost and Impacts of California Phase 2 Gasoline Regulations," NPRA Annual Meeting, Mar. 22–24, 1992, pp. 1–11.
Cunningham, Robert E., Michalski, George W. and Miller, Charles L. "WSPA Study of the Cost Impacts of Potential CARB Phase 2 Gasoline Regulations," WSPA Contract No. DF 201–06, Phases I, II and III, Tuner, Mason & Company, Nov. 18, 1991, pp. 1–63 plus tables.
Taylor, John Kennan, "Quality Assurance of Chemical Measurements," Lewis Publishers Inc., 1987, pp. 27–28, and Appendix C, p. 267.
Herman, Marilyn J. and Learned, Andrea J., "Survey of Federal and State Oxygenated Fuel Regulations, Motor Fuel Laws and Tax Incentives," Herman & Associates, Washington, D.C., Jul. 1989, p. vii.
ASTM Designation: D 4815–89, "Standard Test Method for Determination of $C_1$ to $C_4$ Alcohols and MTBE in Gasoline by Gas Chromatography," Dec. 1989, pp. 626–630.
ASTM Designation: D 4815–87, "Standard Test Method for Benzene and Toluene in Finished Motor and Aviation Gasoline by Gas Chromatography," Dec. 1987, pp. 24–31.
ASTM Designation: D 3606–87, "Standard Test Method for Sulfur in Petroleum Products by X–Ray Spectrometry," Dec. 1987, pp. 322–324.
CRC Report No. 510, "1978 Fuel Rating Program: Road Octane Performance in 1978 Model Cars," CRC Project No. CM–116–78, Coordinating Research Council, Inc., Motor Vehicle Fuel, Lubricant, and Equipment Research Committee, Aug. 1979, pp. 1–27 plus Appendices A–H.
Case No. CV–95–2379–KMW, *Union Oil Company of California* v. *Atlantic Richfield Company et al.,* United States District Court Central District of California, Joint List of Admitted Trial Exhibits (All Phases).
CRC Report No. 493 describing Fuel 288, Jul. 1977.
CRC Report No. 494 describing Fuel 6 and Fuel 10, Oct. 1977.
SAE Report No. 770811 describing Fuel F–1, Sep. 1977.
CRC Report No. 477 describing Fuel 14, Feb. 1975.
SAE Report No. 902132 describing Fuel F, Oct. 1990.
CRC Report No. 454 describing Fuel Au, Oct. 1973.
CRC Report No. 477 describing Fuel 12, Feb. 1975.
CRC Report CM 79–71 and Report No. 461 descring Fuel 14, Jun. 1973.
SAE Report No. 730836 descring Fuel C, date unknown.
1984 ASTM Standards for RVP, T50 and Hydrocarbon Types.
"GM Bids for Radically New Gasoline," *Oil & Gas J.,* Jan. 17, 1972, pp. 53–54.
"GM still want costly light gasoline" *Oil & Gas J.,* Oct. 2, 1972, pp. 44 and 46.
Piel, William J., "Ethers will pay key role in 'clean' gasoline bends." *Oil & Gas J.,* Dec. 4, 1989, pp. 40–44.
Dyroff, George V., ASTM Manual on Significance of Tests for Petroleum Products, Sixth Ed., Chapter 4 "Automotive Gasoline", pp. 24–33.
"Changes keep HF alkylation up–to–date." *Oil & Gas J.,* Feb. 11, 1974, pp. 78–82.
Pahl et al., "Fuel Blending And Analysis for the Auto/Oil Air Quality Improvement Research Program," SAE Technical Paper Series 902098, Oct. 1990.
"Refiners, Automakers Differences Aired in Dearborn," *Octane Week*, Apr. 30, 1990.
Unzelman, George H., "Reformulated Gasolines Will Challenge Product—Quality Maintenance," *Oil & Gas J.,* Apr. 9, 1990, pp. 43–48.
ASTM D 439–70, pp. 173–183.
Cunningham, Robert F. and Miller, Charles L., "Costs and Impacts of California Phase 2 Gasoline Regulations," Presented at the 1992 NPRA Annual Meeting Mar. 22–24, 1992.
Mullen, Liz "Unocal vows not to disrupt cleaner gas debut." *Los Angeles Business J.,* Apr. 10–16, 1995.
*Union Oil Co. of California* v. *Atlantic Richfield Co.,* 208 F.3d 989 (Fed. Cir. 2000).
EPA Draft Regulatory Impact Analysis: Control of Gasoline Volatility and Evaporative Hydrocarbon Emissions From New Motor Vehicles (Jul. 1987).
EPA Final Regulatory Impact Analysis for Phase I and Phase II Gasoline Volatility Regulations (Jan. 1989).
EPA Final Rule: Volatility Rgualtions for Gasoline and Alcohol Blends Sold in Calendar Years 1989 and Beyond (Mar. 1989).
EPA Final Regulatory Impact Analysis for Phase II Gasoline Volatility Regulations (May 1990).

* cited by examiner

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–19, 21–52, 55, 58–70, 76 77, 80, 82–111, 118, 119, 122–124, 128–132, 136, 138–152, 154; 117 as dependent on 1, 32, 38, 43, 52, 60, 64, 61, 68, 69, 87, 88, 96, 101, 105, 106, 109, 128, 44, 13, 90, 91, 143, 144, 70, 110, 41, 76, 118, 119; 120 as dependent on 1, 2, 49, 63, 87, 88, 100, 109, 122, 90, 91, 70, 118, 119; and 121 as dependent on 1, 2, 49, 63, 87, 88, 100, 109, 122, 90, 91, 70, 118, 119 were previously disclaimed.

Claims 20, 53, 54, 56, 57, 71–75, 78, 79, 81, 112–116, 117, 120, 121, 125–127, 133–135, 137, 153, and 155 are cancelled.

* * * * *